US006808872B2

(12) United States Patent
Kudo

(10) Patent No.: US 6,808,872 B2
(45) Date of Patent: Oct. 26, 2004

(54) SILVER SALT PHOTOTHERMOGRAPHIC DRY IMAGING MATERIAL

(75) Inventor: Shinji Kudo, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/458,209

(22) Filed: Jun. 10, 2003

(65) Prior Publication Data

US 2004/0005521 A1 Jan. 8, 2004

(30) Foreign Application Priority Data

Jun. 19, 2002 (JP) ..... 2002-178386
Aug. 19, 2002 (JP) ..... 2002-237982
Sep. 26, 2002 (JP) ..... 2002-280890

(51) Int. Cl.[7] ..... G03C 1/498; G03C 1/38

(52) U.S. Cl. ..... 430/619; 430/527; 430/530; 430/600; 430/607; 430/613; 430/619; 430/965

(58) Field of Search ..... 430/527, 530, 430/619, 631, 965, 600, 613, 607

(56) References Cited

U.S. PATENT DOCUMENTS 6,413,712 B1 * 7/2002 Yoshioka et al. ..... 430/619

6,548,240 B2 * 4/2003 Yamaguchi ..... 430/619

* cited by examiner

*Primary Examiner*—Thorl Chea

(74) *Attorney, Agent, or Firm*—Muserlian, Lucas and Mercanti

(57) ABSTRACT

A silver salt photothermographic material exhibiting enhanced image quality and superior uniformity without causing uneven density is disclosed, comprising on a support a light-sensitive layer comprising a light-sensitive emulsion containing organic silver salt grains and light-sensitive silver halide grains, a reducing agent and a binder and a conductive layer, wherein the conductive layer contains at least one of compounds represented by the following general formulas:

| | |
|---|---|
| $(Rf_2)—(A_2)_s$ | $LiO_3S—(CF_2)_m—SO_3Li$ |
| $MO_3S—(CF_2)_t—SO_3M$ | $L[O_3S—(CF_2)_u—SO_3]$ |

17 Claims, No Drawings

SILVER SALT PHOTOTHERMOGRAPHIC DRY IMAGING MATERIAL

FIELD OF THE INVENTION

The present invention relates to black-and-white silver salt photothermographic dry imaging materials having superior image quality and exhibiting superior uniformity without unevenness.

BACKGROUND OF THE INVENTION

In the field of graphic arts and medical treatment, there have been concerns in processing of photographic film with respect to effluent produced from wet-processing of image-forming materials, and recently, reduction of the processing effluent is strongly demanded in terms of environmental protection and space saving.

There has been desired a photothermographic material for photographic use, capable of forming distinct black images exhibiting high sharpness, enabling efficient exposure by means of a laser imager or a laser image setter.

Known as such a technique is a silver salt photothermographic dry imaging material which comprises on a support an organic silver salt, light sensitive silver halide grains, and reducing agent, as described in U.S. Pat. Nos. 3,152,904 and 3,487,075, and D. Morgan, "Dry Silver Photographic Materials" (Handbook of Imaging Materials, Marcel Dekker, Inc. page 48, 1991) and JP-A No. 2001-272746 (hereinafter, the term, JP-A refers to Japanese Patent Application Publication). In such photothermographic materials, no solution type processing chemicals is used, providing a simple and environment friendly system to users.

These photothermographic materials, which comprise a photosensitive layer containing light-sensitive silver halide grains as a photosensor and an organic silver salt as a silver source, together with a reducing agent are thermally developed usually at a temperature of 80 to 140° C. to form an image, without being further subjected to fixing.

However, when developed using commonly known apparatuses and methods, the foregoing photothermographic materials often result in non-uniform images. Specifically when continuously processed, such a tendency became marked, producing problems in uneven density. Such defects are permissible in the field applying texts and line images for the most part. However, in the field applying medical, industrial and graphic images, further enhanced levels of uniformity in density and color tone, stability of color tone (i.e., neutralness or natural blackness), and image quality have been desired. In this regard, techniques for enhancing uniformity in processed images, specifically, uniformity in neutral solid images are also disclosed in the foregoing literature.

SUMMARY OF THE INVENTION

Accordingly, it is an object of the present invention to provide a silver salt photothermographic dry imaging material (hereinafter, also denoted simply as photothermographic material) exhibiting enhanced image quality and superior uniformity without causing uneven density, an image recording method and image forming method by use thereof, and a preparation method thereof.

The object of the invention can be accomplished by the following constitution:

1. A silver salt photothermographic material comprising on a support a light-sensitive layer comprising a light-sensitive emulsion containing organic silver salt grains and light-sensitive silver halide grains, a reducing agent and a binder and a conductive layer, wherein the conductive layer contains at least one of compounds represented by the following formulas (2a) through (2e):

$$(Rf_1)_p\text{-}(Y)\text{-}(A_1)_q \qquad \text{formula (2a)}$$

wherein $Rf_1$ represents a fluorine-containing substituent group; Y represents a linkage group containing no fluorine atom; $A_1$ represents an anion group or its salt; p is an integer of 1 to 5 and q is an integer of 1 to 5, provided that $A_1$ is not $SO_3K$ when p and q are each 1, $Rf_1$ is $—C_8F_{17}$ and Y is $—CH_2CH_2—$;

$$(Rf_2)\text{-}(A_2)_s \qquad \text{formula (2b)}$$

wherein $Rf_2$ represents a fluorine-containing group; $A_2$ represents an anion group or its salt; and s is an integer of 2 to 5;

$$LiO_3S\text{-}(CF_2)_m\text{-}SO_3Li \qquad \text{formula (2c)}$$

wherein m is an integer of 1 to 4;

$$MO_3S\text{-}(CF_2)_t\text{-}SO_3M \qquad \text{formula (2d)}$$

wherein M represents H, Na, K or an ammonium group; t is a positive integer, provided that when M is H, t is 1 to 6 or 8, when M is Na, t is 4, when M is K, t is 1 to 6, and when M is an ammonium group, t is 1 to 8;

$$L[O_3S\text{-}(CF_2)_u\text{-}SO_3] \qquad \text{formula (2e)}$$

wherein L is Ba, Ca or Mg; u is a positive integer, provided that when L is Ba, u is 1 to 5, when L is Ca or Mg, u is 1 to 8;

2. The photothermographic material described above, wherein at least one of the light-sensitive layer and a layer adjacent thereto contains a compound represented by the following formula (1):

formula (1)

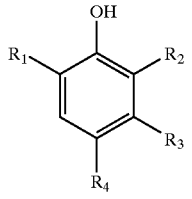

wherein $R_1$ represents an alkyl group; $R_2$ represents a hydrogen atom, an alkyl group, or an acylamino group, provided that neither $R_1$ nor $R_2$ is 2-hydroxyphenylmethyl $R_3$ represents a hydrogen atom, or an alkyl group; and $R_4$ represents a substituent group.

DETAILED DESCRIPTION OF THE INVENTION

The silver salt photothermographic dry imaging material according to this invention comprises a support provided thereon with a light-sensitive layer and a conductive layer.

The conductive layer may be provided on either side of the support. Thus, the conductive layer may be provided on the light-sensitive side or on the opposite side from the light-sensitive layer. The conductive layer is provided preferably on the opposite side of the support from the light-sensitive layer. The conductive layer is also preferably provided on the light-sensitive layer.

In the foregoing formula (1), $R_1$ is an unsubstituted or substituted alkyl group. Thus, the alkyl group preferably has 1 to 30 carbon atoms, which may be substituted. Examples of the alkyl group include methyl ethyl, n-butyl, i-propyl, t-butyl, t-octyl, t-amyl, sec-butyl, cyclohexyl, and 1-methylcyclohexyl. An alkyl group sterically larger (or more bulky) than i-propyl is preferred, such as i-propyl, i-nonyl, t-butyl, t-butyl, t-amyl, t-octyl, cyclohexyl, 1-methyl-cyclohexyl and adamantly. Further, a secondary or tertiary alkyl group is more preferred, and a tertiary alkyl group, such as t-butyl, t-octyl or t-amyl is still more preferred. The alkyl group may be substituted and examples of a substituent include a halogen atom, aryl group, alkoxy group, amino group, acyl group, acylamino group, alkylthio group, arylthio group, sulfonamido group, acyloxy group, oxycarbonyl group, carbamoyl group, sulfamoyl group, sulfonyl group, and phosphoryl group.

$R_2$ is a hydrogen atom, unsubstituted or substituted alkyl group, or unsubstituted or substituted acylamino group, provided that neither $R_1$ nor $R_2$ is not 2-hydroxyphenylmethyl group. In this case, an alkyl group having 1 to 30 carbon atoms is preferred. The alkyl group represented by $R_2$ is the same as defined in $R_1$. An acylamino group having 1 to 30 carbon atoms is preferred. Examples of the acylamino group include acetylamino, alkoxyacetylamino and aryloxyacetylamino. $R_2$ preferably is a hydrogen atom or an alkyl group having 1 to 24 carbon atoms, such as methyl, i-propyl or t-butyl. Further, $R_1$ is not 2-hydroxyphenylmethyl and $R_2$ is also not 2-hydroxyphenylmethyl.

$R_3$ is an unsubstituted or substituted alkyl group, preferably an alkyl group having 1 to 30 carbon atoms, and more preferably 1 to 24 carbon atoms. The alkyl group represented by $R_3$ is the same as defined in the foregoing $R_1$. Either of $R_2$ and $R_3$ preferably is a hydrogen atom.

$R_4$ is a group capable of being substituted on a benzene ring. Preferred examples of such a group include an alky group having 1 to 30 carbon atoms (e.g., methyl, ethyl, propyl, butyl, amyl, octyl, i-propyl, t-butyl, t-amyl, t-octyl sec-butyl, cyclohexyl, 1-methylcyclohexyl, benzyl, methoxymethyl, methoxyethyl) and oxycarbonyl group having 2 to 30 carbon atoms. The alkyl group may be substituted and examples of a substituent include an aryl group, amino group, alkoxy group, oxycarbonyl group, acylamino group, acyloxy group, imido group, and ureido group. Of these, an aryl group, amino group and oxycarbonyl group is preferred. These substituents may further be substituted.

Specific examples of the phenol compound represented by formula are shown below but are by no means limited to these.

1-1

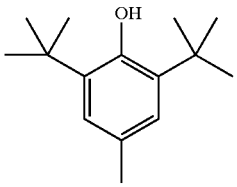

1-2

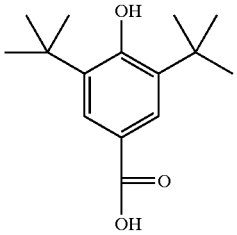

-continued 1-3

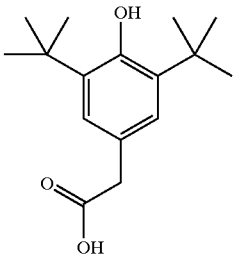

1-4

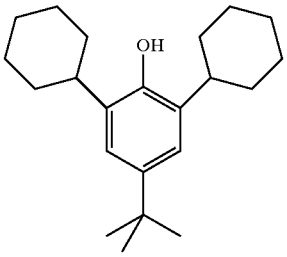

1-5

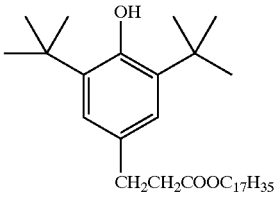

1-6

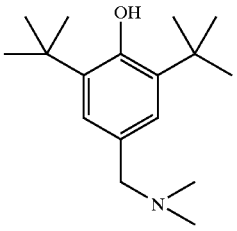

1-7

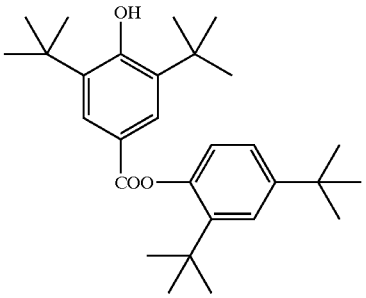

1-8

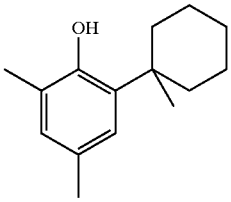

-continued 1-9

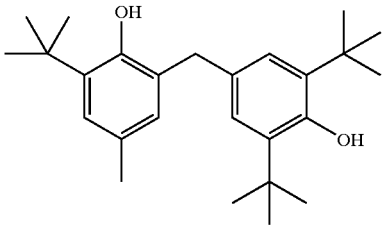

1-10

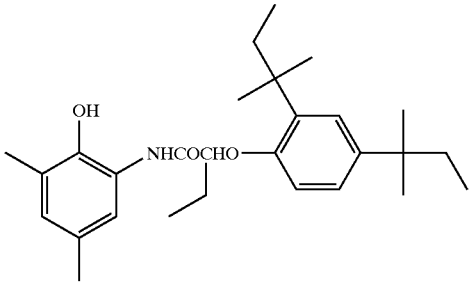

The foregoing compound represented by formula (1) is incorporated into a light-sensitive material of the photothermographic material or a layer adjacent to the light-sensitive layer. The compound can be added into a coating solution, in any form, for example, in the form of solution, emulsion or solid particle dispersion, and is allowed to be contained in the photothermographic material. The compound of formula (1) is contained preferably in an amount of $1\times10^{-4}$ to 2 mol, and more preferably $5\times10^{-4}$ to 0.2 mol per mol of silver contained in photothermographic material.

In the formula (2a), $Rf_1$ is a fluorine-containing substituent group. Examples of such a substituent group include an alkyl group having 1 to 25 carbon atoms (e.g., methyl, ethyl, butyl, octyl, dodecyl, octadecyl) and alkenyl group having 1 to 25 carbon atoms (e.g., propenyl, butenyl, nonenyl, dodecenyl), each of which contains fluorine atom(s), i.e., a fluorinated alkyl or alkenyl group. The linkage group designated by Y is an atomic group mainly comprised of carbon atom(s) and hydrogen atom(s) . $A_1$ is an anion group or its salt, and representative examples thereof include carboxyl group and its salt (sodium salt, potassium salt, lithium salt), sulfo group and its salt (sodium salt, potassium salt, lithium salt), and phosphoric acid group (sodium salt, potassium salt, lithium salt).

The compound represented by formula (2a) can be obtained by addition reaction or condensation reaction between fluorine-introduced alkyl or alkenyl radical (having 1 to 25 carbons atoms) and tri- to hexa-hydric alkanol (or hexa-hydric alcohol), tri- to hexa-hydric aromatic compound or tri- to hexa-hydric heterocyclic compound, or through electrolytic fluorination. Example of the alkanol include glycerine, pentaerythritol, 2-methyl-2-hydroxymethyl-1,3-propanediol, 2,4-dihydroxy-3-hydroxymethylpentene, 1,2,6-hexanetriol, 1,1,1-tris(hydroxymethyl)propane2,2-bis(butanol)-3-aliphatic-triol, tetrmethylolmethane, D-sorbitol, xylitol, and D-mannitol. Example of the aromatic compound and heterocyclic compound include 1,3,5-trihydroxybenzene and trihydroxypyridine.

A salt of a sulfo group (such as $SO_3Li$ or $SO_3Na$) as an exemplary anion group can be introduced by commonly known methods, for example, by sulfonation of the alkanol compound described above or salt exchange through hydrolysis of $FO_2S(CF_2)_nSO_2F$.

Specific examples of preferred compounds represented by formula (2a) are shown below but are by no means limited to these.

2a-1

$CH_2OC_6F_{13}$
|
$CHCH_2OSO_3Na$
|
$CH_2OSO_3Na$ 2a-2

$CH_2OC_6F_{13}$
|
$CHCH_2OSO_3Li$
|
$CH_2OSO_3Li$ 2a-3

$CH_2OC_9F_{17}$
|
$CHCH_2OSO_3Li$
|
$CH_2OSO_3Li$ 2a-4

$CH_2OC_9H_{17}$
|
$C_9F_{17}OCH_2CCH_2OSO_3Li$
|
$CH_2OSO_3Li$ 2a-5

$CH_2OC_6F_{13}$
|
$CHOSO_3Na$
|
$CH_2OSO_3Na$ 2a-6

$CH_2OC_6F_{13}$
|
$CHOSO_3Li$
|
$CH_2OSO_3Li$ 2a-7

$CH_2OC_9F_{17}$
|
$CHOSO_3Li$
|
$CH_2OSO_3Li$ 2a-8

$CH_2OSO_3Li$
|
$C_9F_{17}OCH_2CCH_2OSO_3Li$
|
$CH_2OSO_3Li$ 2a-9

$CH_2OC_8F_{15}$
|
$CHOSO_3Li$
|
$CHOSO_3Li$
|
$CHOSO_3Li$
|
$CHOSO_3Li$
|
$CH_2OC_8F_{15}$ 2a-10

$CH_2OC_8F_{15}$
|
$CHOSO_3Li$
|
$CHOSO_3Li$
|
$CHOSO_3Li$
|
$CHOSO_3Li$
|
$CH_2OSO_3Li$

-continued 2a-11

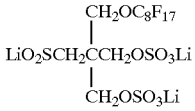

2a-12

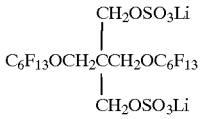

2a-13

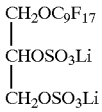

2a-14\

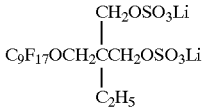

In the formula (2b), $Rf_2$ is a fluorine-containing group. Examples thereof include fluorine-containing aryl group or a group derived from an aryl group (e.g., phenyl) or fluorine-containing cycloalkyl group or a group derived from a cycloalkyl group (e.g., cyclohexyl), and a fluorine-containing phenyl group or group derived from an aryl group is specifically preferred.

$A_2$ is an anion group or its salt and examples thereof are the same as cited in $A_1$ described earlier.

Specific examples of the compound represented by formula (2b) are shown below but are not limited to these.

2b-1

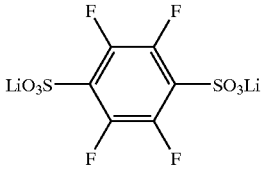

2b-2

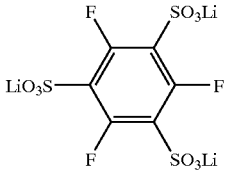

2b-3

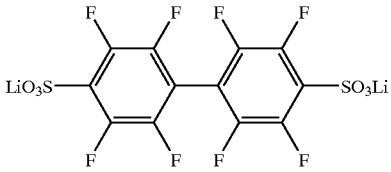

2b-4

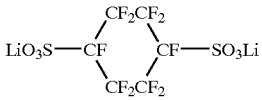

-continued 2b-5

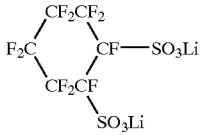

2b-6

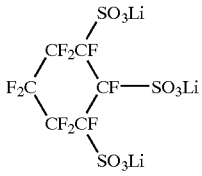

2b-7

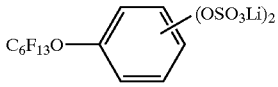

2b-8

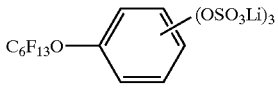

2b-9

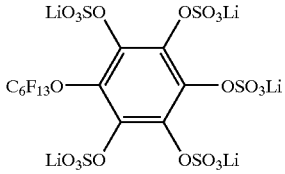

2b-10

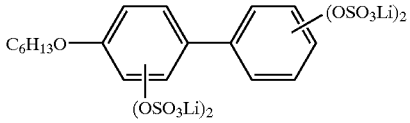

Compounds represented by formula (2c) can be obtained by the commonly known method, for example by salt exchange through hydrolysis of $FO_2S(CF_2)_mSO_2F$ obtained by electrolytic fluorination of $FO_2S(CH_2)_mSO_2F$. Specific examples of the compound are shown below.

2c-1: $LiO_3S(CF_2)SO_3Li$ 2c-2: $LiO_3S(CF_2)_2SO_3Li$ 2c-3: $LiO_3S(CF_2)_3SO_3Li$ 2c-4: $LiO_3S(CF_2)_4SO_3Li$

Compounds represented by formula (2d) can be obtained by the commonly known method, for example by salt exchange through hydrolysis of $FO_2S(CF_2)_tSO_2F$ obtained by electrolytic fluorination of $FO_2S(CH_2)_tSO_2F$. Ammonium group designated by M is not only $NH_4$ but also primary to quaternary organic ammonium groups, substituted by one to four alkyl groups (e.g., methylammonium, dibutylammonium, trimethylammonium, tetradodecylammonium).

Specific examples of compounds represented by formula (2) are shown below.

2d-1: $HO_3S(CF_2)SO_3H$ 2d-2: $HO_3S(CF_2)_2SO_3H$ 2d-3: $HO_3S(CF_2)_4SO_3H$ 2d-4: $HO_3S(CF_2)_6SO_3H$ 2d-5: $HO_3S(CF_2)_8SO_3H$ $NaO_3S(CF_2)_4SO_3Na$ 2d-6:

$KO_3S(CF_2)SO_3K$ 2d-7:

$KO_3S(CF_2)_3SO_3K$ 2d-8:

$KO_3S(CF_2)_6SO_3K$ 2d-9:

$H_4NO_3S(CF_2)SO_3NH_4$ 2d-10:

$H_4NO_3S(CF_2)_2SO_3NH_4$ 2d-11:

$H_4NO_3S(CF_2)_4SO_3NH_4$ 2d-12:

$H_4NO_3S(CF_2)_6SO_3NH_4$ 2d-13:

$(C_2H_5)_3HNO_3S(CF_2)SO_3NH(C_2H_5)_3$ 2d-14:

$(C_2H_5)_3HNO_3S(CF_2)_3SO_3NH(C_2H_5)_3$ 2d-15:

$(C_2H_5)_3HNO_3S(CF_2)_6SO_3NH(C_2H_5)_3$ 2d-16:

$H_4NO_3S(CF_2)_8SO_3NH_4$ 2d-17:

$HO_3S(CF_2)_3SO_3H$ 2d-18:

$HO_3S(CF_2)_3SO_3H_3N(CH_2CH_2O)_{20}CH_2CH_2NH_3O_3S(CF_2)_3SO_3H$ 2d-19:

Similarly to the foregoing compound represented by formula (2e), compounds represented by formula (2e) can be obtained by the commonly known method, for example by hydrolysis of $FO_2S(CF_2)_uSO_2F$, followed by salt exchange with alkaline earth metals.

$Ba[O_3S(CF_2)SO_3]$ 2e-1:

$Ba[O_3S(CF_2)_3SO_3]$ 2e-2:

$Ba[O_3S(CF_2)_5SO_3]$ 2e-3:

$Ca[O_3S(CF_2)SO_3]$ 2e-4:

$Ca[O_3S(CF_2)_2SO_3]$ 2e-5:

$Ca[O_3S(CF_2)_4SO_3]$ 2e-6:

$Ca[O_3S(CF_2)_6SO_3]$ 2e-7:

$Ca[O_3S(CF_2)_8SO_3]$ 2e-8:

$Mg[O_3S(CF_2)SO_3]$ 2e-9:

$Mg[O_3S(CF_2)_3SO_3]$ 2e-10:

$Mg[O_3S(CF_2)_5SO_3]$ 2e-11:

$Mg[O_3S(CF_2)_7SO_3]$ 2e-12:

$Mg[O_3S(CF_2)_8SO_3]$ 2e-13:

In the photothermographic material relating to this invention, the conductive layer preferably contains a non-ionic fluorine-containing surfactant represented by the following formula (2f):

$Rf_3\text{-}(AO)_k\text{-}Rf_4$ formula (2f)

wherein $Rf_3$ and $Rf_4$ are each a fluorine-containing aliphatic group, which may be the same or different; AO is a group containing at least one alkyleneoxy group; k is an integer of 1 to 30 (and preferably 5 to 15). The fluorine-containing aliphatic group represented by $Rf_3$ and $Rf_4$ may be straight chain, branched or cyclic one and preferably is a fluoroalkyl group (e.g., —$C_4F_9$, —$C_8F_{17}$), sulfofluoroalkyl group (e.g., —$C_7F_{14}SO_3$, —$C_8F_{16}SO_3$), $C_nF_{2n+1}SO_2N(R_1)R_2$—, in which $R_1$ is a hydrogen atom, 1 to 20 carbon-containing alkyl, alkoxy or alkylcarboxyl group, aryl group, $R_2$ is a 1 to 20 carbon-containing alkylene or alkylencarboxyl group, and n is an integer of 1 to 20, e.g., $C_7F_{15}SO_2N(C_2H_5)CH_2$—, $C_8F_{17}SO_2N(CH_2COOH)CH_2CH_2CH_2$—. The alkyleneoxy group represented by AO include, for example, propyleneoxy and isopropyleneoxy, which may be substituted at the end by a substituent group such as amino group.

Specific examples of the compound represented by formula (2f) are shown below but are not limited to these.

$C_{12}F_{25}(CH_2CH_2O)_{24}C_{12}F_{25}$ 2f-1:

$C_8F_{17}(CH_2CH_2O)_8C_8F_{17}$ 2f-2:

$C_7F_{15}CH(OH)CH_2(CH_2CH_2O)_{15}CH_2CH(OH)CH_2C_7F_{15}$ 2f-3:

$C_7F_{15}(CH_2CH_2O)_{10}C_7F_{15}$ 2f-4:

$C_{12}F_{25}(CH_2CH_2O)_{15}C_{12}F_{25}$ 2f-5:

$C_8F_{17}CH_2CH(OH)CH_2(CH_2CH_2O)_{20}CH_2CH(OH)CH_2C_8F_{17}$ 2f-6:

$C_8F_{17}(CH_2CH_2O)_{18}C_8F_{17}$ 2f-7:

$C_8F_{17}(CH_2CH_2O)_{20}C_8F_{17}$ 2f-8:

$C_7F_{15}SO_2N(C_2H_5)CH_2(CH_2CH_2O)_{22}CH_2N(CH_3)SO_2C_7F_{15}$ 2F-9:

$C_9F_{17}O(CH_2CH_2O)_{22}C_9F_{17}$ 2f-10:

The content of a fluorine-containing surfactant represented by the foregoing formulas (2a) through (2e) is preferably 1 to 200 mg, and more preferably 5 to 100 mg per $m^2$ of photothermographic material. The content of a fluorine-containing surfactant represented by the foregoing formula (2f) is preferably 5 to 600 mg, and more preferably 20 to 400 mg per $m^2$ of photothermographic material. The surfactant represented by the formulas (2a) through (2e) is preferably used in combination with the surfactant represented by the formula (2f).

The compound represented by the formula (1) is preferably by the following formula (1a):

formula (1a)

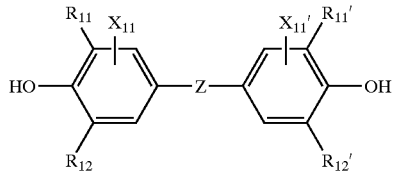

wherein Z represents —S— or —$C(R_{13})(R_{13}')$—, in which $R_{13}$ and $R_{13}'$ each represent a hydrogen atom or a substituent; $R_{11}$, $R_{12}$, $R_{11}'$ and $R_{12}'$ each represent a substituent; $X_{11}$ and $X_{11}'$ each represent a hydrogen atom or a substituent.

In the formula (1a), examples of the substituent represented by $R_{13}$ and $R_{13}'$ include an alky group (e.g., methyl, ethyl, n-propyl, i-propyl, cyclopropyl, n-butyl, i-butyl, sec-butyl, t-butyl, cyclohexyl, 1-methyl-cyclohexyl), alkenyl group (e.g., vinyl, propenyl, butenyl, pentenyl, i-hexenyl, cyclohexenyl, butenilidene, i-pentylidene), alkynyl group (e.g., ethynyl, propynilidene), aryl group (e.g., phenyl, naphthyl), heterocyclic group (e.g., furyl, thienyl, pyridyl, tetrahydrofuranyl), halogen atom, hydroxyl group, alkoxy group, aryloxy group, acyloxy group, sulfonyloxy group, nitro group, amino group, acylamino group, sulfonylamino group, sulfonyl group, carboxy group, alkoxy carbonyl, aryloxycarbonyl group, carbamoyl group, sulfamoyl group, cyano group, and sulfo group. Of these, $R_{13}$ and $R_{13}'$ are each preferably a hydrogen atom or alkyl group.

Substituents represented by $R_{11}$, $R_{12}$, $R_{11}'$ and $R_{12}'$ are the same as defined in the foregoing $R_{13}$ and $R_{13}'$. $R_{11}$, $R_{12}$, $R_{11}'$ and $R_{12}'$ preferably are each an alkyl group, alkenyl group, alkynyl group, aryl group and heterocyclic group, more preferably an alkyl group, and still more preferably a tertiary alkyl group such as t-butyl, t-amyl, t-octyl or 1-methylcyclohexyl. These alkyl groups may be substituted by substituents described above.

The substituent represented by $X_{11}$ and $X_{11}'$ is the same as defined in the foregoing $R_{13}$ and $R_{13}'$.

Specific examples of a bisphenol compound represented by formula (1a) are shown below but are not limited to these.

1a-1

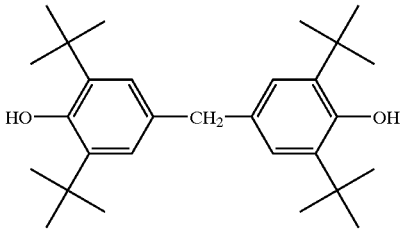

1a-2

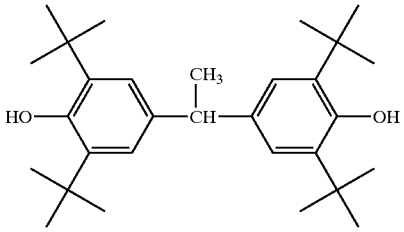

1a-3

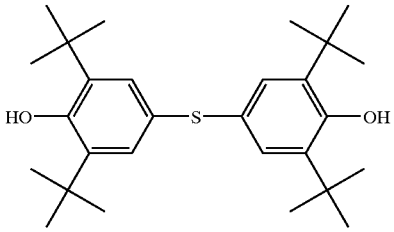

1a-4

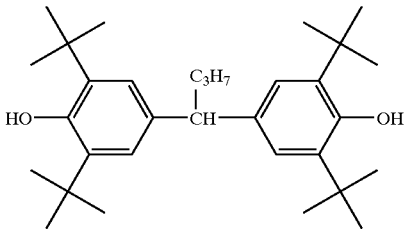

1a-5

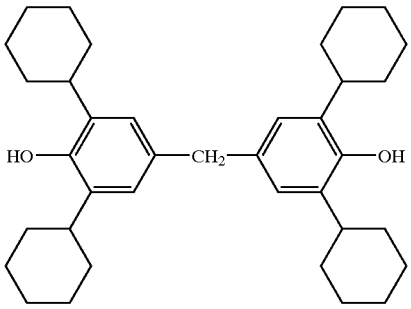

-continued 1a-6

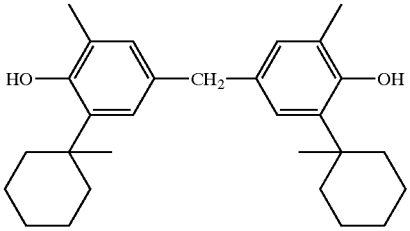

1a-7

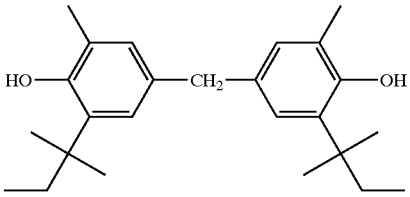

1a-8

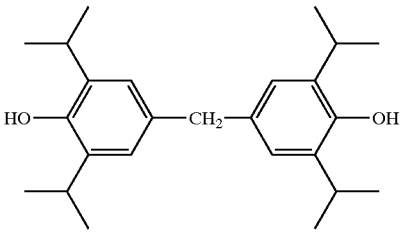

1a-9

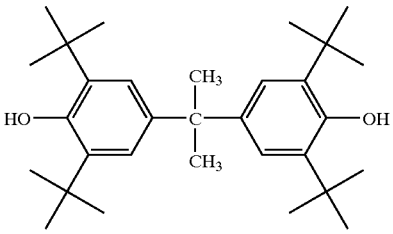

1a-10

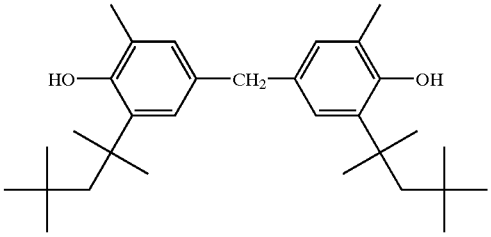

In the photothermographic material relating to this invention, the light-sensitive layer preferably further contains a compound (thiuronium derivative) represented by the following formula (6) and a macrocyclic compound, as a supersensitizer, as described in U.S. Pat. No. 6,475,710.

formula (6)

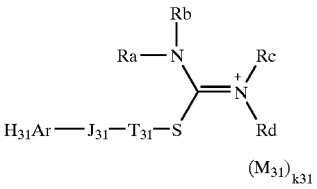

wherein $H_{31}Ar$ represent an aromatic hydrocarbon group or an aromatic heterocyclic group; $T_{31}$ represents a bivalent aliphatic hydrocarbon linkage group or a bond; $J_{31}$ represents a bivalent linking group containing at least one of an oxygen atom, sulfur atom and nitrogen atom, or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to compensate for an intramolecular charge; and $k_{31}$ represents the number of the ion necessary to compensate for an intramolecular charge.

Examples of a bivalent linking group containing at least one of an oxygen atom, sulfur atom and nitrogen atom, represented by $J_{31}$ include the following groups, which may be combined:

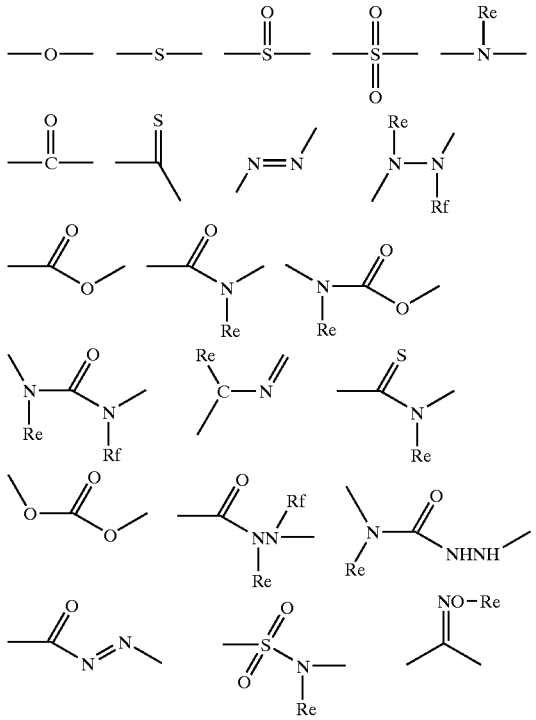

wherein Re and Rf are the same as defined in Ra through Rd.

The compound represented by the foregoing formula (6) is detailed in U.S. Pat. No. 6,475,710 described above. Specific examples of the compound are shown below.

6-1

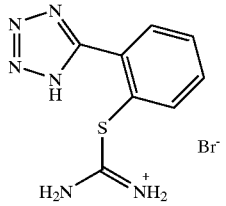

6-2

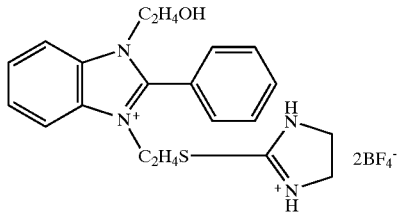

-continued 6-3

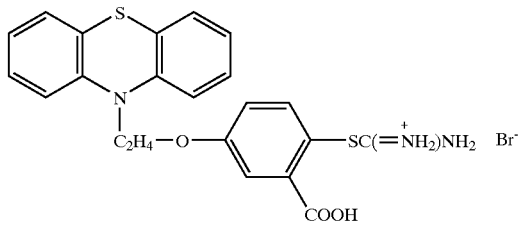

6-4

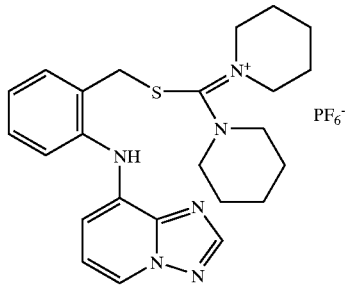

6-5

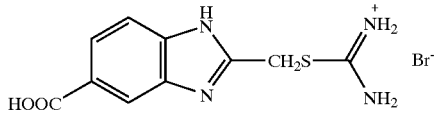

6-6

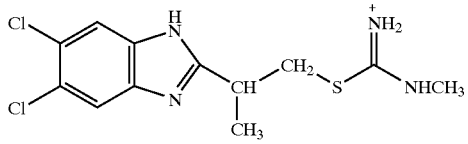

6-7

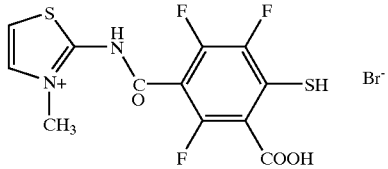

6-8

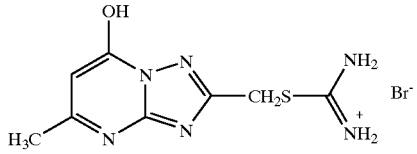

6-9

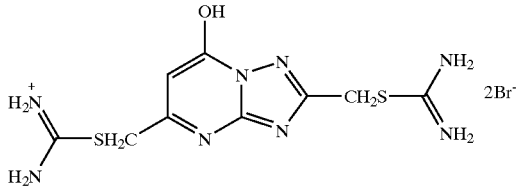

-continued
6-10
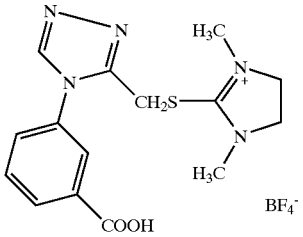
6-11
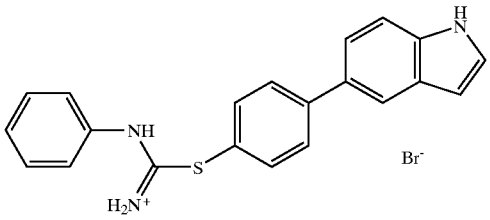
6-12
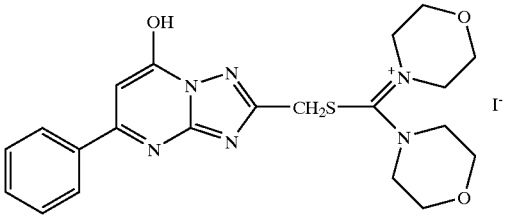
6-13
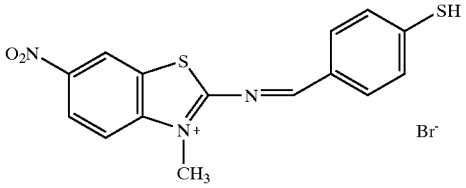
6-14
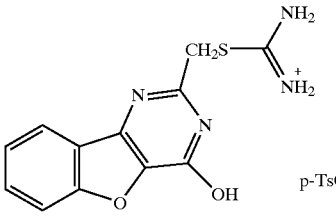
6-15
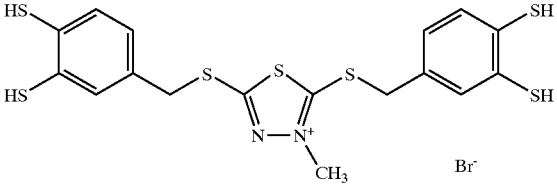
6-16
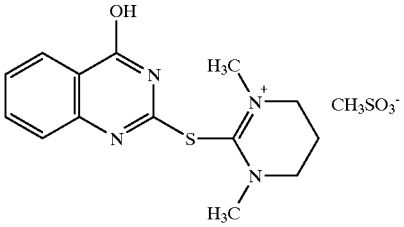
-continued
6-17
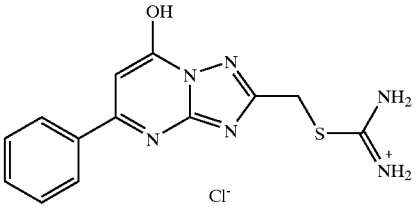
6-18
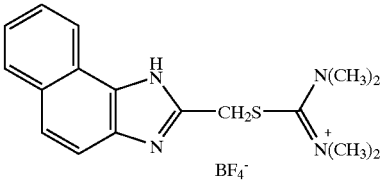
6-19
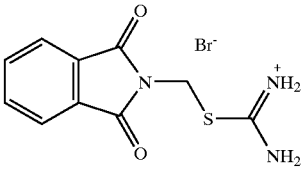
6-20
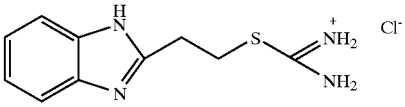
6-21
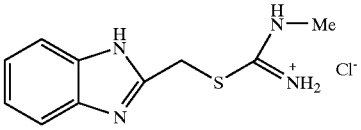
6-22
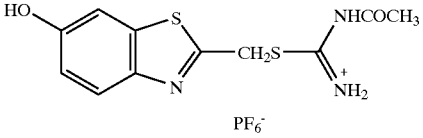
6-23
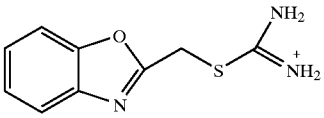
6-24
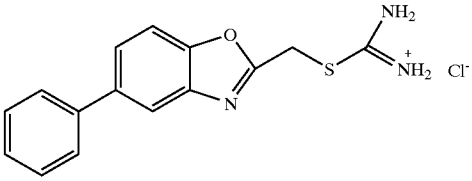
6-25
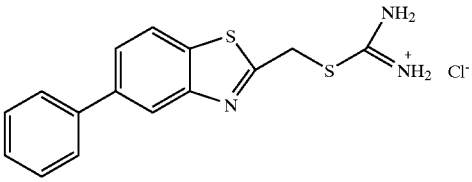

-continued 6-26

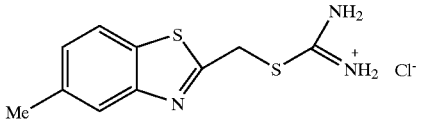

6-27

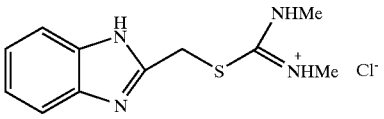

6-28

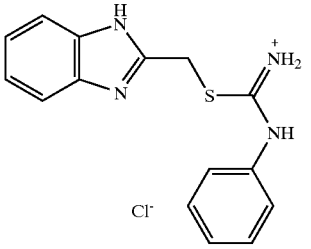

6-29

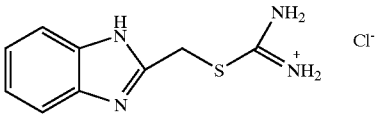

6-30

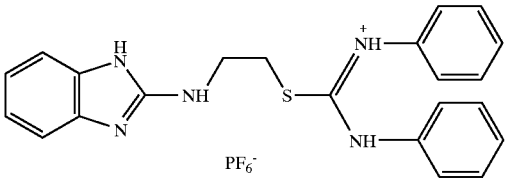

6-31

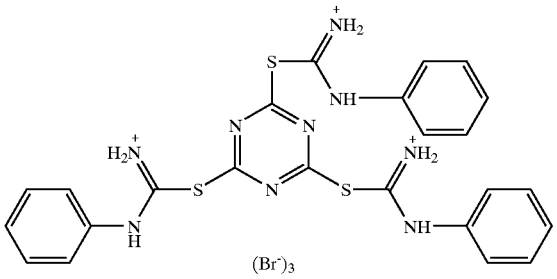

6-32

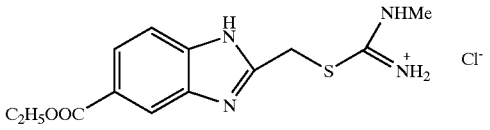

6-33

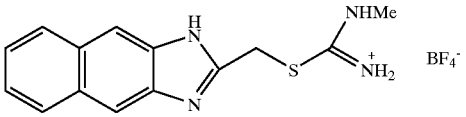

Next, essential materials used in the photothermographic material relating to this invention will be described, including organic silver salts, light-sensitive silver halide, reducing agents, binders, support and various additives.

Organic silver salts are reducible silver source to form silver images, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in Research Disclosure (RD) 17029 and 29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of long chain fatty acids such as behenic acid, arachidic acid and stearic acid are specifically preferred.

The use of a mixture of at least two kinds of organic silver salts is preferred to enhance developability, forming silver images with enhanced density and higher contrast. Such a mixture is prepared preferably by mixing a silver ion solution with a mixture of at least two kinds of organic acids.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form organic silver salt crystals. In this case, silver halide grains may be concurrently present.

In the preparation process of organic silver salt grains, it is preferred to prepare aliphatic carboxylic acid silver salt grains concurrently in the presence of a compound capable of functioning as a crystal growth retarding agent or dispersing agent for aliphatic carboxylic acid silver salt grains. The compound capable of functioning as a crystal growth retarding agent or dispersing agent for aliphatic carboxylic acid silver salt grains refers to one which has a function or effect of forming grains with reduced size and enhanced uniformity thereof when prepared in the presence of the compound, as compared to the absence thereof. Specific examples of such compounds include monohydric alcohols having 10 or less carbon atoms (preferably secondary and tertiary alcohols), glycols such as ethylene glycol and propylene glycol, poly-ethers such as polyethylene glycol, and glycerin. Such compounds are added in an amount of 10 to 200% by weight, based on aliphatic carboxylic acid silver salt.

Branched aliphatic carboxylic acids including isomers thereof are also preferable, such as isoheptanoic acid, isodecanoic acid, isotridecanoic acid, isomyristic acid, isopalmitic acid, isostearic acid, isoarachidic acid, isobehenic acid and isohexanoic acid. In this case, a preferable branched chain is an alkyl or alkenyl group having 4 or less carbon atoms. Further, unsaturated aliphatic carboxylic acids are cited, such as palmothreic acid, oleic acid, linolic acid, linoleic acid, moroctic acid, eicosenic acid, arachidonic acid, eicopentaenic acid, erucic acid, docosapentaenic acid, and selacholeic acid. These compounds are added in an amount of 0.5 to 10 mol %, based on aliphatic carboxylic acid silver salt.

Preferred compounds include glycosides such as gluciside, galactoside and fructoside; trehalose type disaccharides such as trahalose and sucrose; polysaccharides such as glycogen, dextrin, dextran and alginic acidcellosolves such as methyl cellosolve and ethyl cellosolve; water-soluble organic solvents such as sorbitan, sorbitol, ethyl acetate, methyl acetate, and dimethyl formamide; water-soluble polymers such as polyvinyl alcohol, polyacrylic acid, acrylic acid copolymer, maleic acid copolymer, carboxymethyl cellulose, hydroxypropyl cellulose, hydroxypropylmethyl cellulose, polyvinyl pyrrolidone and gelatin. These compounds are added preferably in an amount of 0.1 to 20% by weight.

Alcohols having 10 or less carbon atoms are preferred, and the use of secondary or tertiary alcohols enhances solubility of sodium salt of an aliphatic carboxylic acid, resulting in reduced viscosity and enhancing stirring efficiency, leading to formation of monodisperse fine grains. Branched aliphatic carboxylic acids and unsaturated carboxylic acids exhibit higher steric hindrance than straight chain aliphatic carboxylic acids, resulting in fine crystals due to increased disorder in crystal lattice.

Organic silver salt grains may be of almost any shape but are preferably tabular grains. Tabular organic silver salt grains are specifically preferred, exhibiting an aspect ratio of 3 or more. The tabular organic silver salt grains exhibiting an aspect ratio of 3 or more" means that at least 50% by number of the total organic silver salt grains is accounted for by such tabular grains having an aspect ratio of 3 or more. The organic silver salt grains having an aspect ratio of 3 or more accounts for more preferably at least 60% by number, still more preferably at least 70% by number, and specifically preferably at least 80% by number. The tabular organic silver salt particle having an aspect ratio of 3 or more refers to an organic salt grain exhibiting a ratio of grain diameter to grain thickness, a so-called aspect ratio (also denoted as AR) of 3 or more, which is defined as below:

$$AR=\text{diameter}(\mu m)/\text{thickness}(\mu m)$$

wherein when an organic silver salt grain is approximated to be a rectangular parallelepiped, the diameter is the maximum edge length (also denoted as MX LNG) and the thickness is the minimum edge length (also denoted as MN LNG).

The aspect ratio of the tabular organic silver salt grain is preferably within the range of 3 to 20, and more preferably 3 to 10. In the case of an aspect ratio of less than 3, the organic salt particles easily form closest packing and in the case of the aspect ratio being excessively high, organic silver salt grains are easily superposed and dispersed in a coating layer in the form of being brought into contact with each other, easily causing light scattering and leading to deterioration in transparency of the photothermographic material.

Methods to prepare organic silver salt grains having the above-mentioned shape are not particularly limited. The optimization of various conditions such as maintaining the mixing state during the formation of an organic acid alkali metal salt soap and/or the mixing state during the addition of silver nitrate to said soap. After tabular organic silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (dissolver), as a high speed shearing stirrer (homo-mixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc. Examples of ceramics employed as the ceramic beads include $Al_2O_3$, $BaTiO_3$, $SrTiO_3$, MgO, ZrO, BeO, $Cr_2O_3$, $SiO_3$, $SiO_2$—$Al_2O_3$, $Cr_2O_3$—MgO, MgO—CaO, MoO—C, MgO—$Al_2O_3$ (spinel), SiC, $TiO_2$, $K_2O$ , $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_3$-6$SiO_2$ (artificial emerald), C (artificial diamond), $SiO_2$—n$H_2O$, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular organic silver salt grains employed in the present invention, preferably employed as the members which are in contact with the organic silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the organic silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 300 to 1,000 kgf/cm$^2$. In the case when a media-dispersing machine is employed, a circumferential speed of 6 to 13 m/sec. is preferable.

In one preferred embodiment of this invention, when the cross section, vertical to the support of the photothermographic material is observed through an electron microscope, organic silver salt particles exhibiting a grain projected area of less than 0.025 $\mu m^2$ account for at least 70% of the total grain projected area and organic silver salt particles exhibiting a grain projected area of not less than 0.2 $\mu m^2$ account for not more than 10% of the total grain projected area. In such a case, coagulation of the organic silver salt grains is minimized in the light sensitive emulsion, resulting in a homogeneous distribution thereof.

The conditions for preparing the light sensitive emulsion having such a feature are not specifically limited but include, for example, mixing at the time of forming an alkali metal soap of an organic acid and/or mixing at the time of adding silver nitrate to the soap being maintained in a favorable state, optimization of the ratio of the soap to the silver nitrate, the use of a media dispersing machine or a high pressure homogenizer for dispersing pulverization, wherein dispersion is conducted preferably in a binder content of 0.1 to 10% by weight, based on the organic silver salt, the dispersion including the preliminary dispersion is carried out preferably at a temperature of not higher than 45° C., and a dissolver, as a stirrer is preferably operated at a circumferential speed of at least 2.0 m/sec.

The projected area of organic silver salts grain having a specified projection area and the desired proportion thereof, based on the total grain projection area can be determined by the method using a transmission type electron microscope (TEM) in a similar manner, as described in the determination of the average thickness of tabular grains having an aspect ratio of 3 or more. In this case, coagulated grains are regarded as a single grain when determining the grain area (AREA). At least 1000 grains, and preferably at least 2000 grains are measured to determine the area and classified into three groups, i.e., A: less than 0.025 $\mu m^2$, B: not less than 0.025 $\mu m^2$ and less than 0.2 $\mu m^2$ and C: more than 0.2 $\mu m^2$. In this invention, it is preferable that the total projected area of grains falling within the range of "A" accounts for at least 70% of the projected area of the total grains and the total projected area of grains falling within the range of "C" accounts for not more than 10% of the projected area of total grain.

When measurements are carried out employing the above-mentioned procedures, it is desirable that in advance, employing a standard sample, the length correction (scale correction) per pixel as well as two-dimensional distortion correction of the measurement system is adequately carried out. As the standard sample, Uniform Latex Particles (DULP), marketed by Dow Chemical Co. in the USA are suitable. Polystyrene particles having a variation coefficient of less than 10 percent for a diameter of 0.1 to 0.3 $\mu m$ are preferred. Specifically, a type having a particle diameter of 0.212 $\mu m$ as well as a standard deviation of 0.0029 $\mu m$ is commercially available.

Details of image processing technology may be had by referring to "Gazoshori Oyogijutsu (Applied Technology in Image Processing)", edited by Hiroshi Tanaka, (Kogyo Chosa Kai). Image processing programs or apparatuses are not particularly restricted, as long as the above-mentioned operation is possible. Cited as one example is Luzex-III, manufactured by Nireko Co.

The organic silver salt grains used in this invention are preferably monodisperse. The degree of mono-dispersity is preferably 1 to 30% and monodisperse particles in this range lead to the desired high density images. The degree of mono-dispersity is defined as below:

Degree of mono-dispersity=(standard deviation of particle size)/(average particle size)×100(%). The average particle size (circular equivalent diameter) of organic silver salt is preferably 0.01 to 0.8 $\mu m$, and more preferably 0.05 to 0.5 $\mu m$. The particle size refers to the diameter of a circle having an area equivalent to the projected area of the particle (i.e., circular equivalent diameter).

To prevent hazing of the photothermographic material, the total amount of silver halide and organic silver salt is preferably 0.5 to 2.2 g in equivalent converted to silver per $m^2$, thereby leading to high contrast images.

Light-sensitive silver halide grains used in this invention are those which are capable of absorbing light as an inherent property of silver halide crystal or capable of absorbing visible or infrared light by artificial physico-chemical methods, and which are treated or prepared so as to cause a physico-chemical change in the interior and/or on the surface of the silver halide crystal upon absorbing light within the region of ultraviolet to infrared.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 $\mu m$, more preferably between 0.01 and 0.17 $\mu m$, and still more preferably between 0.02 and 0.14 $\mu m$. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below of not more than 7%; more preferably not more than 5%, still more preferably not more than 3%, and most preferably not more than 1%:

Coefficient of variation of grain size=standard deviation of grain diameter/average grain diameter×100(%)

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer surface of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. The low molecular weight gelatin can be obtained by subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation.

The concentration of dispersion medium used in the nucleation stage is preferably not more than 5% by weight, and more preferably 0.05 to 3.0% by weight.

Silver halide may be incorporated into an image forming layer by any means, in which silver halide is arranged so as to be as close to reducible silver source as possible. It is general that silver halide, which has been prepared in advance, added to a solution used for preparing an organic silver salt. In this case, preparation of silver halide and that of an organic silver salt are separately performed, making it easier to control the preparation thereof. Alternatively, as described in British Patent 1,447,454, silver halide and an organic silver salt can be simultaneously formed by allowing a halide component to be present together with an organic silver salt-forming component and by introducing silver ions thereto. Silver halide can also be prepared by reacting a halogen containing compound with an organic silver salt through conversion of the organic silver salt. Thus, a silver halide-forming component is allowed to act onto a preformed organic silver salt solution or dispersion or a sheet material containing an organic silver salt to convert a part of the organic silver salt to photosensitive silver halide.

The silver halide-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogenated compounds, such as N-bromosucciimde, N-bromophthalimide, and N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an organic silver salt to silver halide through reaction of the organic silver salt and a halide ion. The silver halide separately prepared may be used in combination with silver halide prepared by conversion of at least apart of an organic silver salt. The silver halide which is separately prepared or prepared through conversion of an organic silver salt is used preferably in an amount of 0.001 to 0.7 mol, and more preferably 0.03 to 0.5 mol per mol of organic silver salt.

Silver halide used in the invention preferably includes ions of metals belonging to Groups 6 to 11 of the Periodic Table. Preferred as the metals are W, Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

Reducing agents are incorporated into the photothermographic material of the present invention. Examples of suitable reducing agents are described in U.S. Pat. Nos. 3,770,448, 3,773,512, and 3,593,863, and Research Disclosure Items 17029 and 29963, and an optimum reducing agent can be used by the selection from those commonly known in the art. In cases where fatty acid silver salts are used as an organic silver salt, polyphenols in which at least two phenyl groups are linked through an alkylene group or a sulfur atom and specifically, bisphenols in which two phenyl groups which are substituted, at the position adjacent to the hydroxy group-substituted position, with at least an alkyl group (e.g., methyl, ethyl, propyl, t-butyl, cyclohexyl, etc.) or an acyl group (e.g., acetyl, propionyl, etc.) are linked through an alkylene group or a sulfur atom. For example, the compound represented by the following formula formula (A)

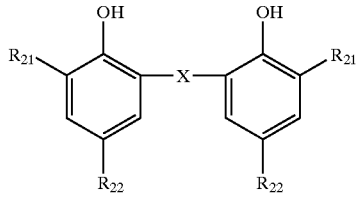

wherein X represents a chalcogen atom or $CHR_{20}$, in which $R_{20}$ is a hydrogen atom, a halogen atom, an aliphatic group having 7 or less carbon atoms or a 6- or less-membered cyclic group; $R_{21}$ and $R_{22}$ each represent a hydrogen atom or a substituent.

The chalcogen atom represented by X is sulfur, selenium, or tellurium atom, in which sulfur atom is preferred. Examples of the halogen atom represented by $R_{20}$ include a fluorine atom, chlorine atom and bromine atom. Examples of the aliphatic group having 7 or less carbon atoms include methyl, ethyl, propyl, butyl, hexyl, heptyl, vinyl, allyl, butenyl, hexadienyl, etenyl-2-propenyl, 3-butenyl, 1-methyl-3-propenyl, 3-pentenyl and 1-methyl-3-pentenyl. The 6- or less-membered cycle groups include an acyclic group, heterocyclic group and carbocyclic group, in which 4- to 6-membered alicyclic groups such as cyclobutene, cyclopentyl, cyclopentenyl, cyclohexyl, cyclohexenyl, cyclohexadienyl, and phenyl are preferred; as a heterocyclic ring forming the heterocyclic group are preferred a pyrazolo ring, pyrrole ring, pyrrolidine ring, pyrimidine ring, pyrazine ring, pyridine ring, triazine ring, thiazole ring, furan ring, and pyrane ring. A hydrogen atom and a cyclic group of cycloalkyl, cycloalkenyl and phenyl are specifically preferred.

The foregoing groups may be substituted. Examples of substituent groups include a halogen atom (e.g., fluorine, chlorine, bromine), cycloalkyl group (e.g., cyclohexyl, cycloheptyl), cycloalkenyl group (e.g., 1-cyclalkenyl, 2-cycloalkenyl), alkoxy group (e.g., methoxy, ethoxy, propoxy), alkylcarbonyloxy group (e.g., acetyloxy), alkylthio group (e.g., methylthio, trifluoromethylthio), carboxyl group, alkylcarbonylamino group (e.g., acetylamino), ureido group (e.g., methylaminocarbonylamino), alkylsulfonyl group (e.g., methanesulfonyl, trifluoromethanesulfonyl), carbamoyl group (e.g., carbamoyl, N,N-dimethylcarbamoyl, N-morpholinocarbonyl), sulfamoyl group (e.g., sulfamoyl, N,N-dimethylsulfamoyl, morpholinosulfamoyl), trifluoromethyl, hydroxy, nitro, cyano, alkylsulfonamido group (e.g., methanesulfonamido, butanesulfoneamido), alkylamino group (e.g., N,N-dimethylamino, N,N-diethylamino), sulfo group, phosphono group, sulfite group, sulfino group, alkylsulfonylaminocarbonyl group (e.g., methanesulfonylaminocarbonyl, ethanesulfonylaminocarbonyl), alkylcarbonylaminosulfonyl group (e.g., acetoamidosulfonyl, methoxyaceto- amidosulfonyl), alkynylaminocarbonyl group (e.g., acetoamidocarbonyl, methoxyacetoamidocarbonyl), and alkylsulfinylaminocarbonyl group (e.g., methanesulfinylaminocarbonyl, ethane sulfinylamino- carbonyl). In the case of plural substituent groups, they may be the same of different.

$R_{21}$ and $R_{22}$ are each a hydrogen atom, halogen atom or substituent. Examples of the halogen atom include fluorine, chlorine and bromine. Examples of the substituent include an alkyl group, aryl group, cycloalkyl group, alkenyl group, cycloalkenyl group, alkynyl group, amino group, acyl group, acyloxy group, acylamino group, sulfonylamino group, sulfamoyl group, carbamoyl group, alkylthio group, sulfonyl group, alkylsulfonyl group, sulfinyl group, cyano, and heterocyclic group. Plural $R_{21}$s or $R_{22}$s may be the same or different. $R_{21}$ preferably has 2 or more carbon atoms; $R_{22}$ preferably has 1 to 5 carbon atoms and more preferably one carbon atom.

The foregoing groups may be substituted. Examples of substituent groups include a halogen atom (e.g., fluorine, chlorine, bromine), cycloalkyl group (e.g., cyclohexyl, cycloheptyl), cycloalkenyl group (e.g., 1-cyclalkenyl, 2-cycloalkenyl), alkoxy group (e.g., methoxy, ethoxy, propoxy), alkylcarbonyloxy group (e.g., acetyloxy), alkylthio group (e.g., methylthio, trifluoromethylthio), carboxyl group, alkylcarbonylamino group (e.g., acetylamino), ureido group (e.g., methylaminocarbonylamino), alkylsulfonyl group (e.g., methanesulfonyl, trifluoromethanesulfonyl), carbamoyl group (e.g., carbamoyl, N,N-dimethylcarbamoyl, N-morpholinocarbonyl), sulfamoyl group (e.g., sulfamoyl, N,N-dimethylsulfamoyl, morpholinosulfamoyl), trifluoromethyl, hydroxy, nitro, cyano, alkylsulfonamido group (e.g., methanesulfonamido, butanesulfoneamido), alkylamino group (e.g., N,N-dimethylamino, N,N-diethylamino), sulfo group, phosphono group, sulfite group, sulfino group, alkylsulfonylaminocarbonyl group (e.g., methanesulfonylaminocarbonyl, ethanesulfonylaminocarbonyl), alkylcarbonylaminosulfonyl group (e.g., acetoamidosulfonyl, methoxyacetoamidosulfonyl), alkynylaminocarbonyl group (e.g., acetoamidocarbonyl, methoxyacetoamidocarbonyl), and alkylsulfinylaminocarbonyl group (e.g., methanesulfinylaminocarbonyl, ethane sulfinylaminocarbonyl).

Specific examples of the compound represented by formula (A) are shown below.

A-1

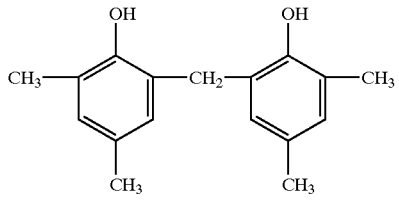

-continued
A-2
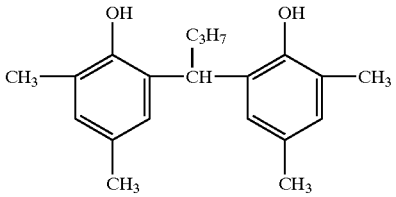
A-3
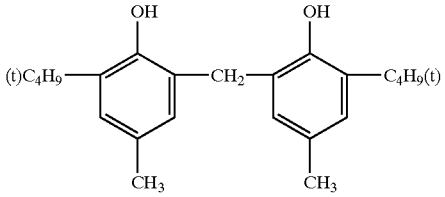
A-4
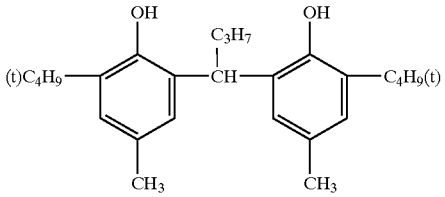
A-5
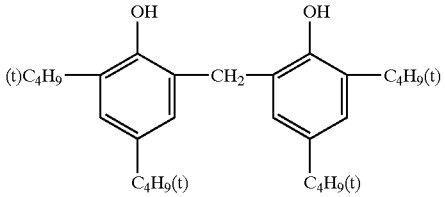
A-6
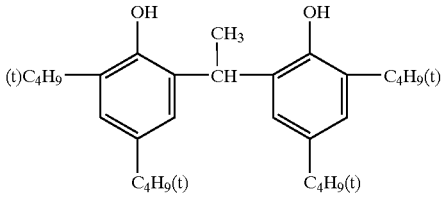
A-7
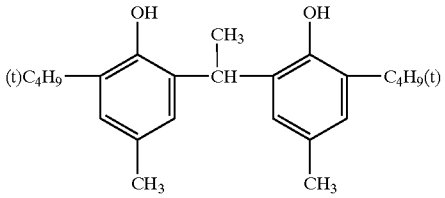
A-8
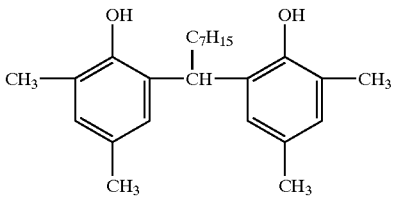
-continued
A-9
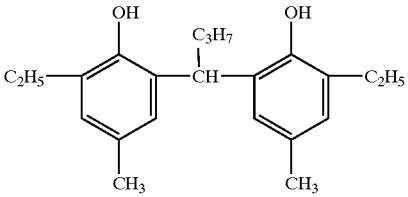
A-10
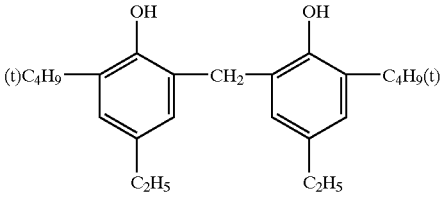
A-11
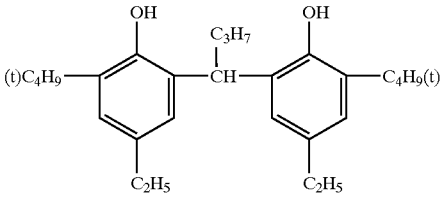
A-12
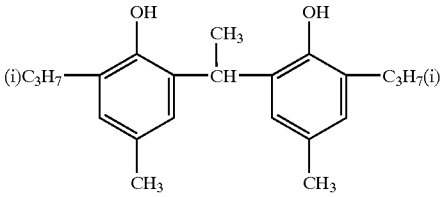
A-13
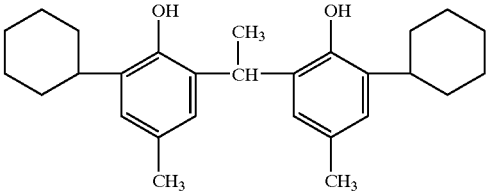
A-14
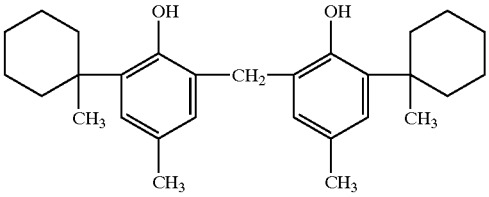
A-15
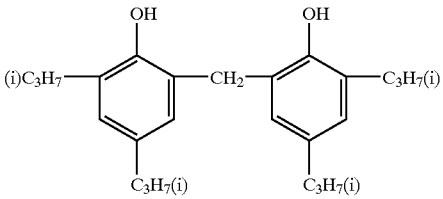

-continued
A-16
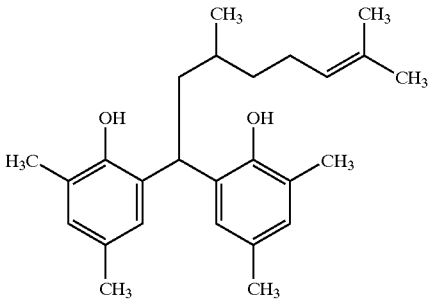
A-17
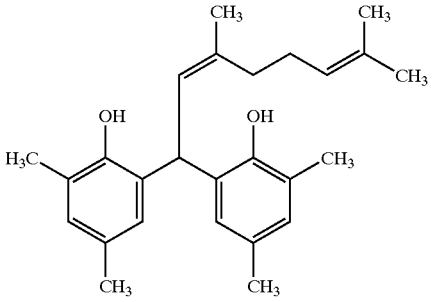
A-18
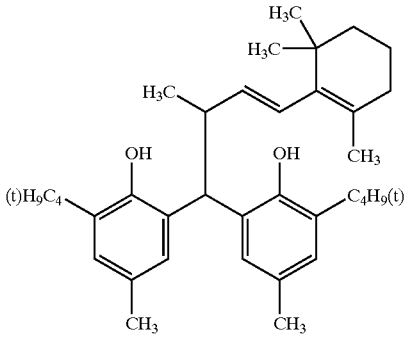
A-19
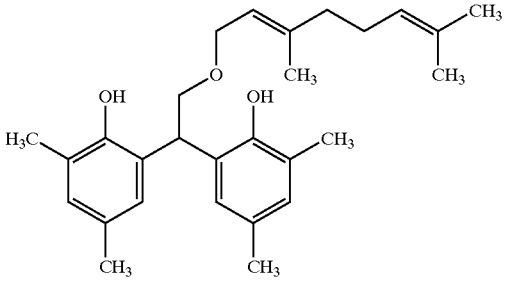
A-20
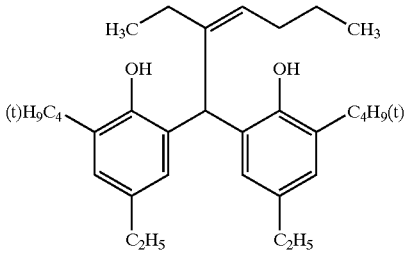
-continued
A-21
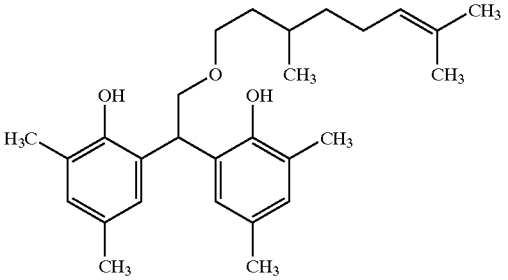
A-22
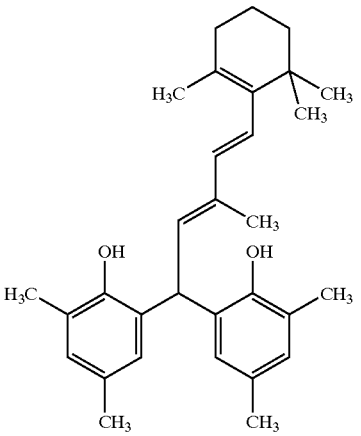
A-23
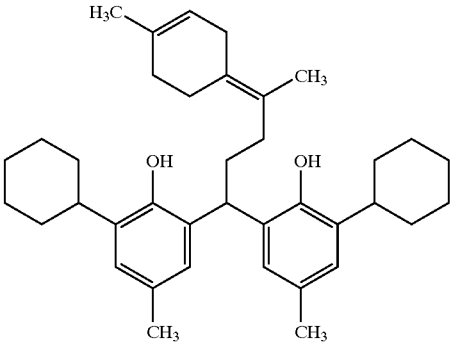
A-24
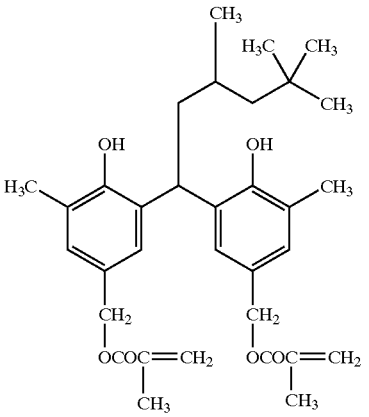

-continued

A-25

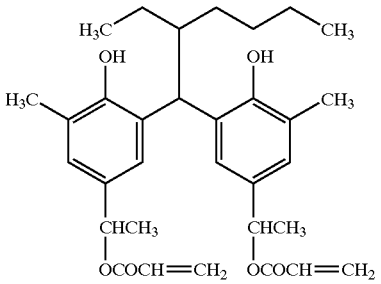

A-26

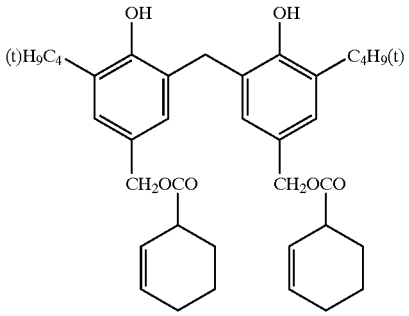

A-27

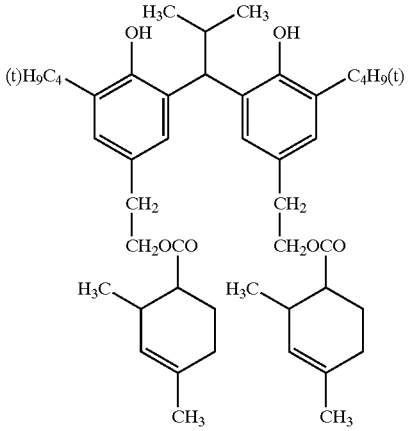

A-28

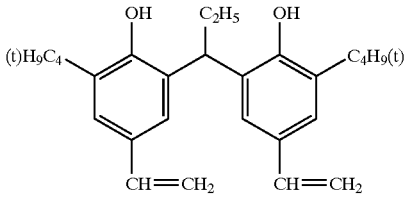

A-29

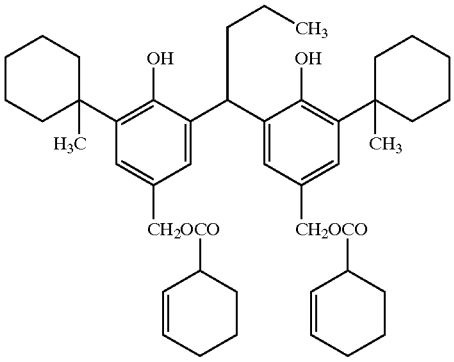

-continued

A-30

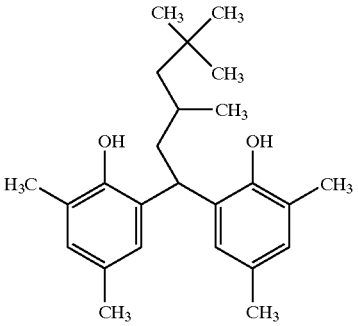

A-31

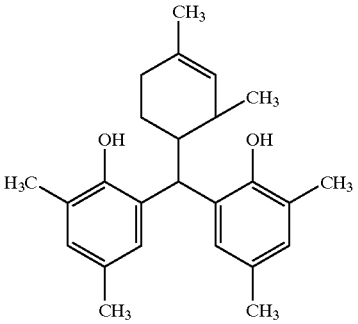

A-32

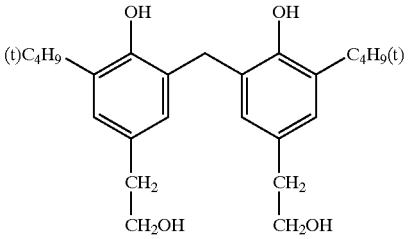

In addition to the foregoing compounds, examples of the reducing agents include polyphenol copounds described in U.S. Pat. Nos. 3.589,903 and 4,021,249; British patent No. 1,486,148; JP-A Nos. 51- 51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfonamidophenol, 2,6-dichloro-4-benzenesulfonamido-phenol and 4-benzenesulfonamidonaphthol.

The amount of a reducing agent to be used, such as the compound represented by formula (A) is preferably $1\times10^{-2}$ to 10 mol and more preferably $1.5\times10^{-2}$ to 1.5 mol per mol silver. Two or more reducing agents may be used in combination, in an amount within the foregoing range.

Addition of the reducing agent to a light sensitive emulsion comprising a light sensitive silver halide, organic silver salt grains and a solvent immediately before coating the emulsion is often preferred, thereby minimizing variation in photographic performance during standing.

It is preferred to use compounds as an auxiliary agent for a reducing agent, such as triphenylphosphineoxide described in European Patent No. 1096310, which are capable of forming a hydrogen bond with a hydrogen of a hydroxyl group of a reducing agent.

Silver halide grains used in the invention can be subjected to chemical sensitization. In accordance with methods described in Japanese Patent Application Nos. 2000-57004 and 2000-61942, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double bond. The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

In photothermographic imaging materials used in the invention, it is preferred to use a light sensitive emulsion, in which light sensitive silver halide has been subjected to chemical sensitization using a chalcogen atom-containing organic sensitizer at a temperature of 30° C. or higher, concurrently in the presence of an oxidizing agent capable of oxidizing silver specks formed on the silver halide grains, then, mixed with an organic silver salt, dehydrated and dried.

Chemical sensitization using the foregoing organic sensitizer is also preferably conducted in the presence of a spectral sensitizing dye or a heteroatom-containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring, indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A NOs. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei.

In this invention, there are also preferably used sensitizing dyes having spectral sensitivity within the infrared region. Examples of the preferred infrared sensitizing dye include those described in U.S. Pat. Nos. 4,536,478, 4,515,888 and 4,959,294. The infrared sensitizing dye according to the invention is preferably a dye characterized in that the dye is a long chain polymethine dye, in which a sulfonyl group is substituted on the benzene ring of the benzothiazole ring. The infrared sensitizing dyes and spectral sensitizing dyes described above can be readily synthesized according to the methods described in F. M. Hammer, The Chemistry of Heterocyclic Compounds vol. 18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom-containing compound capable of being adsorbed onto silver halide, after adding the dye prior to chemical sensitization and allowing it to be adsorbed to silver halide grains, chemical sensitization is conducted, thereby preventing dispersion of chemical sensitization center specks and achieving enhanced sensitivity and minimized fogging. These sensitizing dyes may be used alone or in combination thereof.

The combined use of sensitizing dyes is often employed for the purpose of supersensitization. A super-sensitizing compound, such as a dye which does not exhibit spectral sensitization or substance which does not substantially absorb visible light may be incorporated, in combination with a sensitizing dye, into the emulsion containing silver halide grains and aliphatic carboxylic acid silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (7) is preferred as a supersensitizer:

Ar—SM formula (7)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included:

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula (7a):

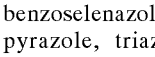

Ar—S—S—Ar Formula (7)

wherein Ar is the same as defined in formula (6).

The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms).

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection. Next, antifoggants and image stabilizers used in the photothermographic imaging material used in the invention will be described.

As a reducing agent used in photothermographic materials are employed reducing agents containing a proton, such as bisphenols. Accordingly, a compound generating a labile species which is capable of abstracting a proton to deactivate the reducing agent is preferred. More preferred is a compound as a non-colored photooxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure. Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds represented by general formula [1] and iodonium compounds represented by general formula [2] in Japanese Patent Application No. 2000-57004.

As a compound capable of deactivating a reducing agent to inhibit reduction of an aliphatic carboxylic acid silver salt to silver by the reducing agent are preferred compounds releasing a labile species other than a halogen atom. However, these compounds may be used in combination with a compound capable of releasing a halogen atom as a labile species. Specific examples of the compound releasing an active halogen atom include a compound represented by the following formula [4] described in the foregoing Japanese Patent Application No. 2000-57004:

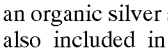

Q—Y—C($X_1$)($X_2$)($X_3$) formula [4]

wherein Q is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(=O)—, —SO— or —$SO_2$—. The respective groups are detailed in paragraph [0088] through [0093] and specific examples of the compounds are 4-1 through 4-64, as shown in paragraph [0095] through [0102].

Further, in addition to the foregoing compounds, compounds commonly known as an antifoggant may be incorporated in the photothermographic imaging material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European patent Nos. 600,587, 605,981 and 631,176.

It is also preferred to us a silver-saving agent in the photothermographic material. The silver saving agent refers to a compound capable of reducing a silver amount necessary to obtain a given density. Various mechanisms of action for the reduction are supposed and a compound having a function of enhancing the covering power of developed silver is preferred, in which the covering power refers to a density per unit weight of silver. Examples of preferred silver saving agents include hydrazine derivatives represented by formula [H], vinyl compounds represented by formula (G), onium compounds represented by formula (P), as described in Japanese Patent Application No. 2001-192698, and alkoxysilane compounds containing at least two primary or secondary amino groups and their salts. The expression, having at least two primary or secondary amino groups refers to having at least two primary amino groups, having at least two secondary amino groups, or having at least one primary amino group and at least one secondary amino group; and "its salt", i.e., salt of the alkoxysilane compound refers to an adduct of the alkoxy silane compound and an inorganic acid or organic acid capable of forming an onium salt together with the amino group.

Binders used in the silver salt photothermographic imaging material are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly(methyl methacrylate), poly (methylmethacrylic acid), polyvinyl chloride, polymethacrylic acid, copoly(styrene-anhydrous maleic acid), copoly(styrene-acrylonitrile), copoly(styrene-butadiene), polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides. These may be hydrophilic or hydrophobic.

Of these, polyvinyl acetals are preferred as a binder used for the light sensitive layer, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light-sensitive layer is preferably 1.5 to 6 $g/m^2$, and more preferably 1.7 to 5 $g/m^2$. The amount of less than 1.5 $g/m^2$ results in an increase in unexposed areas, leading to levels unacceptable in practical use.

The glass transition temperature (Tg) of a binder used in the light-sensitive layer of the photothermographic material is preferably 70 to 105° C. The use of a binder having such a characteristic prevents softening of the layer due to organic acids and raises a thermal transition temperature, resulting in enhanced resistance to abrasion marks. The use of a binder having a Tg less than 70° C. lowers a thermal transition temperature and desired physical properties such as abrasion resistance cannot be achieved. The use of a binder having a Tg exceeding 105° C. results in deteriorated physical properties.

In the photothermographic material relating to the invention, commonly known polymeric compounds are usable. The glass transition point is preferably 70 to 105° C.; the number average molecular weight is preferably 1,000 to 1,000,000, and more preferably 10,000 to 500,000; and the degree of polymerization is preferably 50 to 1000. Examples thereof include compounds of a polymer or copolymer containing ethylenically unsaturated monomers as a constituting unit, such as vinyl chloride, vinyl acetate, vinyl alcohol, maleic acid, acrylic acid, acrylic acid ester, vinylidene chloride, acrylonitrile, methacrylic acid, methacrylic acid ester, styrene, butadiene, ethylene, vinyl butyral, vinyl acetal and vinyl ether; polyurethane resin, and various kinds of rubber resin. In addition thereto, phenol resin, epoxy resin, polyurethane thermally hardening type resin, urea resin, melamine resin, alkyd resin, formaldehyde resin, silicone resin, epoxy-polyamide resin, and polyester resin are also usable. These resins are detailed in "Plastic Handbook" published by Asakura-shoten. The foregoing polymeric compounds are not specifically limited and there is usable any one having a glass transition point (Tg) of 70 to 105° C., including homopolymers and copolymers.

Examples of polymer containing an ethylenically unsaturated monomer as a constituting unit and its copolymer include acrylic acid alkyl esters, acrylic acid aryl esters, methacrylic acid alkyl esters, methacrylic acid aryl esters, cyanoacrylic acid alkyl esters, and cyanoacrylic acid aryl esters, in which the alkyl or aryl group may be substituted. Examples of substituent groups include methyl, ethyl, n-propyl, isopropyl, n-butyl, isobutyl, sec-butyl, tert-butyl, amyl, hexyl, cyclohexyl, benzyl, chlorobenzyl, octyl, stearyl, sulfopropyl, N-ethyl-phenylethyl, 2-(3-phenylpropyloxy)ethyl, dimethylaminophenoxyethyl, furfuryl, tetrahydrofurfuryl, phenyl, cresyl, naphthyl, 2-hydroxyethyl, 4-hydroxybutyl, triethylene glycol, dipropylene glycol, 2-methoxyethyl, 3-methoxybutyl, 2-aetoxyethyl, 2-acetoxyacetoxyethyl, 2-ethoxyethyl, 2-isopropoxy, 2-butoxyethyl, 2- (2-methoxy) ethyl, 2-(2-ethoxyethoxy) ethyl, 2-(2-butoxyethoxy)ethyl, 2-diphenylphosphorylethyl, ω-methoxyethylene glycol (addition mole number n=6)allyl, and a dimethylaminoethyl chloride salt. In addition, the following monomers are also usable, including vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate; N-substituted acrylamides, N-substituted methacrylamides, acrylamides and methacrylamides, in which N-substituting groups include, for example, methyl, ethyl, propyl, butyl, tert-butyl, cyclohexyl, benzyl, hydroxymethyl, methoxyethyl, dimethylaminoethyl, phenyl, dimethyl, diethyl, β-cyanoethyl, N-(2-acetoacetoxyethyl) and diacetone; olefins such as dicyclopentadiene, ethylene, propylene, 1-butene, 1-pentene, vinyl chloride, vinylidene chloride, isoprene, chloprene, butadiene, and 2,3-dimethylbutadiene; styrenes such as methylstyrene, dimethylstyrene, trimethylstyrene, ethylstyrene, isopropylstyrene, tert-butylstyrene, chloromethylstyrene, methoxystyrene, acetoxystyrene, chlorostyrene, dichlorostyrene, bromostyrene, and methyl vinylbenzoate; vinyl ethers such as methyl vinyl ether, butyl vinyl ether, hexyl vinyl ether, methoxyethyl vinyl ether, and dimethylaminoethyl vinyl ether; N-substituted maleimides, in which N-substituting groups include, for example, methyl, ethyl, propyl, butyl, tert-butyl, cyclohexyl, benzyl, n-dodecyl, phenyl, 2-methylphenyl, 2,6-diethylphenyland 2-chlorophenyl; and others such as butyl crotonate, hexyl crotonate, dimethylitaconate, dibutyl itaconate, diethyl maleate, dimetyl maleate, dibutyl maleate, diethyl fumarate, dimethyl fumarate, dibutyl fumarate, methyl vinyl ketone, phenyl vinyl ketone, methoxy ethyl ketone, glycidyl acrylate, glycidyl methacrylate, N-vinyl oxazolidone, N-vinyl pyrrolidone, acrylonitrile, methacrylonitrile, methylene malonitrile, and vinylidene chloride.

Of these polymer compounds are preferred methacrylic acid alkyl esters, methacrylic acid aryl esters and styrenes. Specifically, polymer compounds containing an acetal group are preferred, which are superior in miscibility with organic acids produced, preventing softening of the layer. In this invention, polyvinyl acetal having a acetoacetal structure is preferred as a binder. Examples thereof include polyvinyl acetals, as described in U.S. Pat. Nos. 2,385,836, 3,003,879 and 2,828,204; British patent No. 771,155. Compounds represented by formula (V) described in Japanese Patent Application No. 2000-380225 are also preferred as a polymeric compound having an acetal group.

As is known, the use of cross-linking agents in the foregoing binders improves adhesion of the layer and minimizes unevenness in development, which further inhibits fogging during storage and retards formation of printed-out silver. Various cross-linking agents have been used for photographic materials, including aldehyde type, epoxy type, ethyleneimine type, vinylsulfone type, sulfonic acid ester type, acryloyl type, carbodiimide type and silane compound type cross-linking agents, as described in JP-A No. 50-96216. Of these, cross-linking agents containing an alkoxysilane group, isocyanate group, epoxy group (glycidyl group), vinylsulfone group or carbodiimide group are preferred. A cross-linking agent containing at least two isocyanate groups, a carbodiimide cross-linking agent containing at least two carbodiimide groups, an alkoxysilane cross-linking agent containing at least two alkoxy groups and a vinylsulfonyl cross-linking agent containing at least two vinylsulfonyl groups are specifically preferred. Specific examples of preferred cross-linking agents are shown below.

H-1: hexamethylenediisocyanate
H-2: trimer of hexamethylenediisocyanate
H-3: tolylenediisocyanate
H-4: phenylenediisocyanate
H-5: xylylenediisocyanate
H-6: 1,3-bis(isocyanatomethyl)cyclohexane
H-7: tetrametylenexylylenediisocyanate
H-8: M-I-propenyl-α,α-dimethylbenzylisocyanate
H-9: phenylaminopropyltrimethoxysilane
H-10: p-methylphenylpropyltrimethoxysilane
H-11: dimetylaminopropyltrimethoxysilane
H-12: diethoxyaminopropyltriethoxysilane
H-13: 1,2-bis(vinylsulfonylacetoamido)ethane
H-14: 1,2-bis(vinylsulfonamido)ethane
H-15: 1,2-bis(vinylsulfoneamido)-2-hydroxypropane
H-16: 1,3-bis(vinylsulfonyl)-2-propanol

H-17

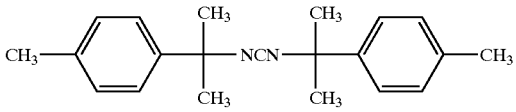

H-18

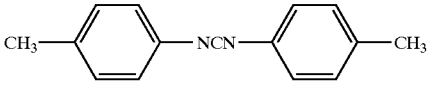

H-19

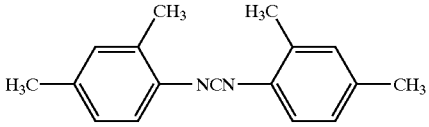

H-20

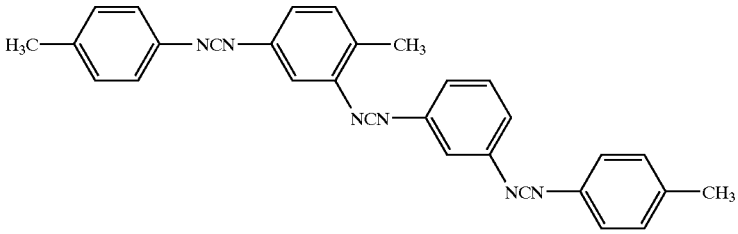

H-21

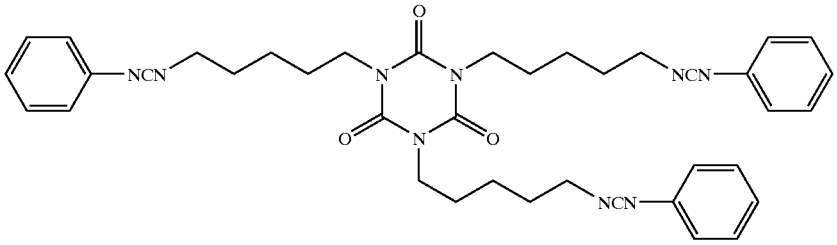

In addition to the foregoing carbodiimide compounds, polyfunctional carbodiimide compounds represented by the following formula 'CI) are also preferred:

$$R_{41}—J_1—N=C=N—J_2—(L)_N—(J_3—N=C—N—J_4—R_{42})_v \quad \text{formula (CI)}$$

Wherein $R_{41}$ and $R_{42}$ represent an alkyl group or aryl group; $J_1$ and $J_2$ represent a divalent linkage group; $J_2$ and $J_3$ represent an alkylene group or arylene group; L represents a (v+1)-valent linkage group derived from al alkyl group, alkenyl group, aryl group or heterocyclic group; v is an integer of 1 or more, and n is 0 or 1. Details of the foregoing groups are described in paragraph [0188] through [0190] of Japanese Patent Application No. 2002-1345.

Specific examples of the carbodiimide compound are shown below.

CI-1

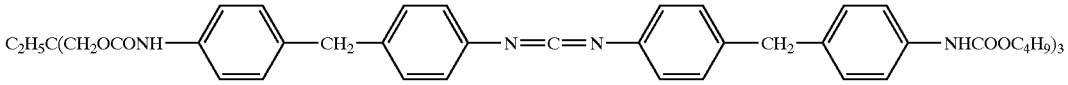

CI-2

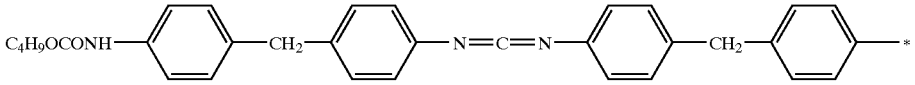

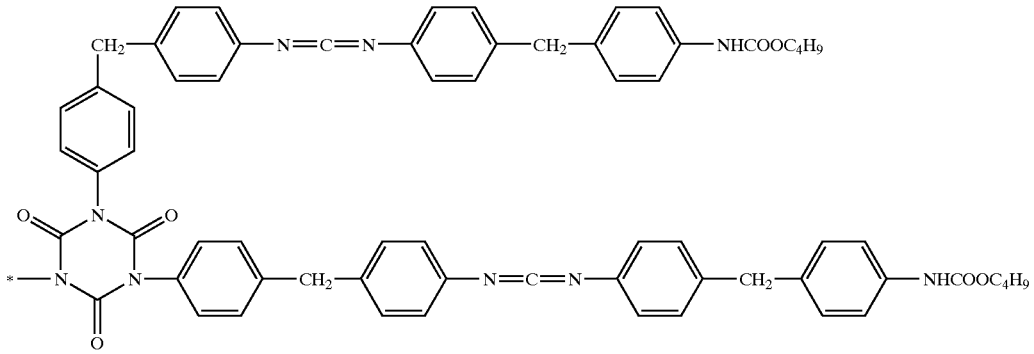

CI-3

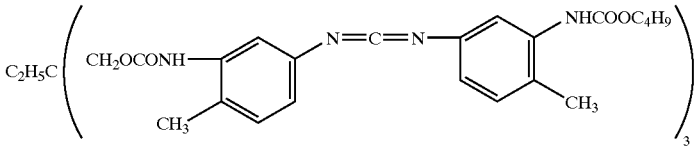

CI-4

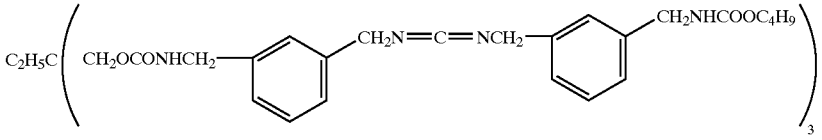

CI-5

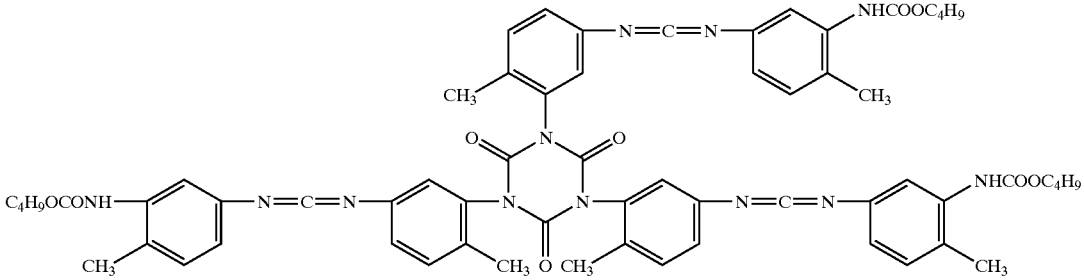

-continued
CI-6
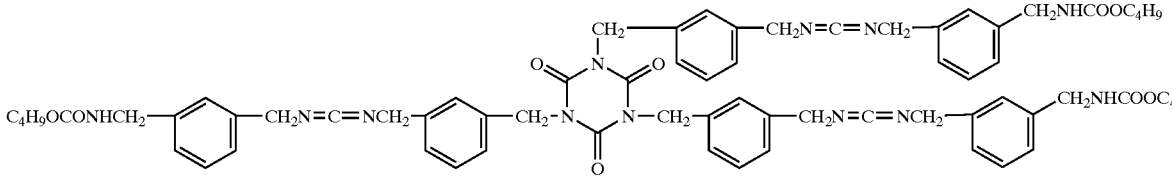
CI-7
$C_2H_5C[CH_2OCONH(CH_2)_6N{=}C{=}N(CH_2)_6NHCOOC_4H_9]_3$
CI-8
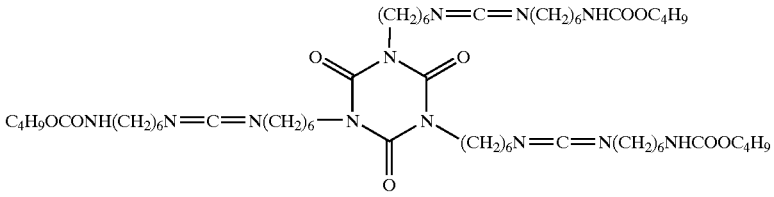
CI-9
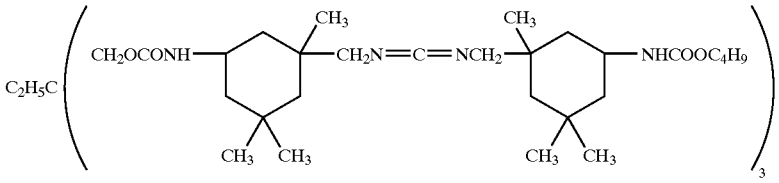
CI-10
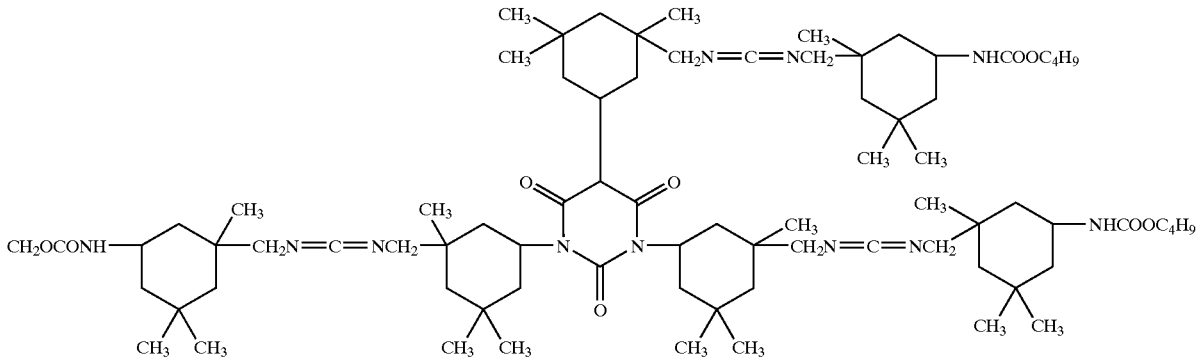
CI-11
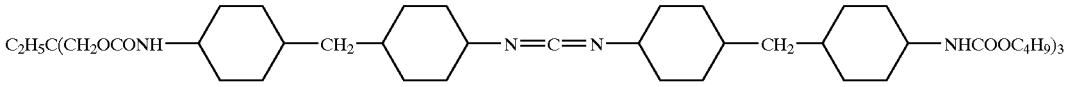
CI-12
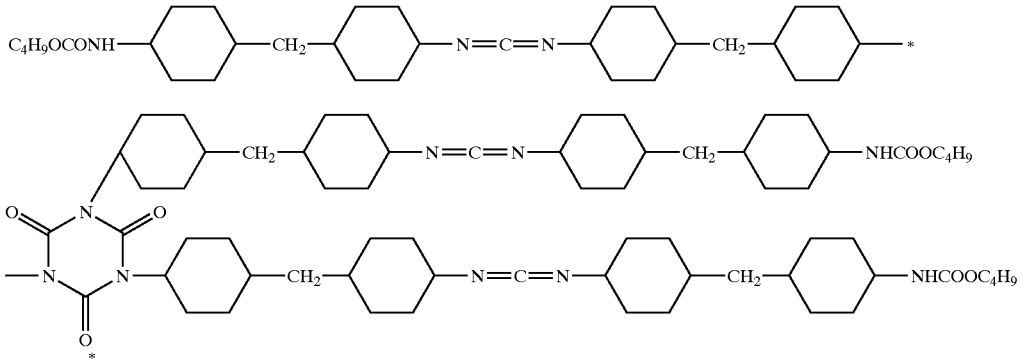
CI-13
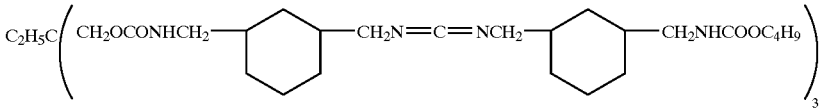

-continued

CI-14

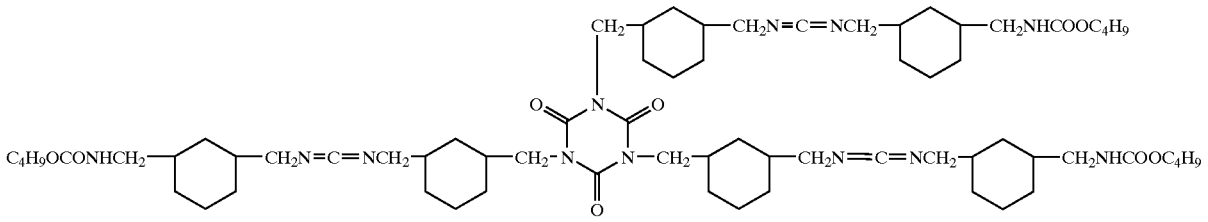

CI-15

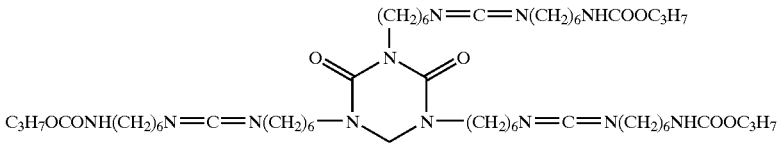

CI-16

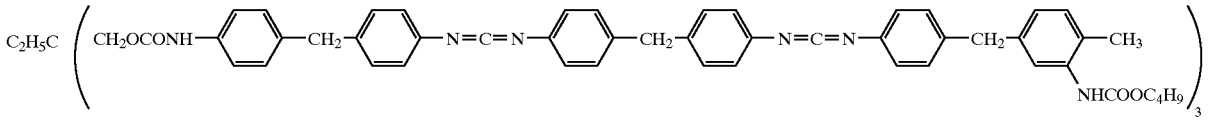

CI-17

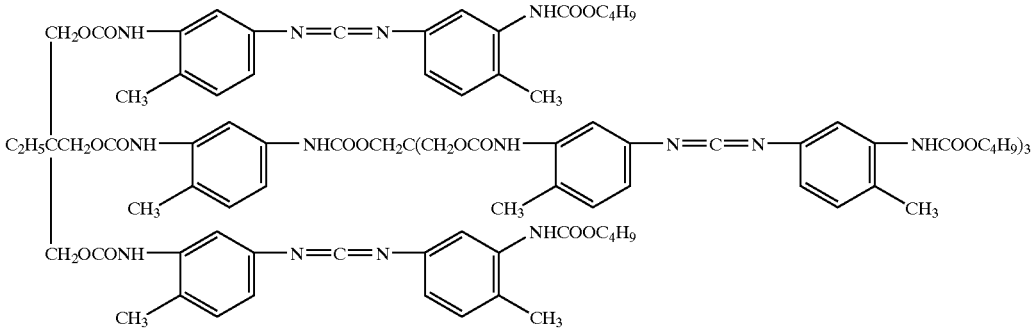

CI-18

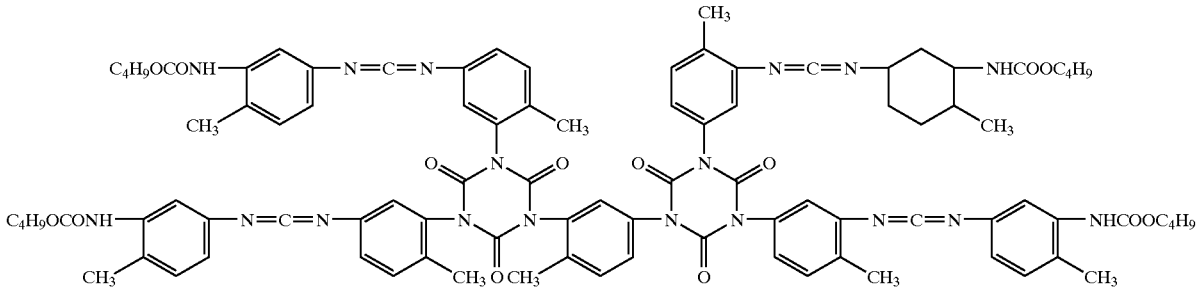

The cross-linking agents described above may be incorporated through solution in water, alcohols, ketones or non-polar solvents, or added in the form of a solid particle dispersion. Addition is preferably in an amount equivalent to a group to be cross-linked and the amount thereof may be increase ten times or decreased to one tenth thereof. An insufficient amount causes no cross-linking and an excessive amount results in deteriorated photographic performance due to remaining cross-linking agents.

In this present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agent employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrene or polymethacrylate described in Swiss Patent No. 330,158, etc.; polyacrylonitrile described in U.S. Pat.

No. 3,079,257, etc.; and polycarbonates described in U.S. Pat. No. 3,022,169.

The matting agent used in the invention preferably has an average particle diameter of 0.5 to 10 μm, and more preferably of 1.0 to 8.0 μm. Furthermore, the variation coefficient of the size distribution is preferably not more than 50%, is more preferably not more than 40%, and is still more preferably not more than 30%. The variation coefficient of the grain size distribution as described herein is a value represented by the following formula:

(standard deviation of particle size/average particle size)×100.

Addition methods of the matting agent include those in which a matting agent is previously dispersed into a coating composition and is then coated, and prior to the completion of drying, a matting agent is sprayed. When plural matting agents are added, both methods may be employed in combination.

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 μm, and preferably 70 to 180 μm.

It is preferred to use image tone modifiers in the photothermographic material. Preferred image tone modifiers are disclosed in RD17029, U.S. Pat. Nos. 4,123,282, 3,994,732, 3,846,136 and 4,021,249. Specifically preferred image tone modifiers are those selected from compounds represented by the following formulas (3), (4) and (5):

formula (3)

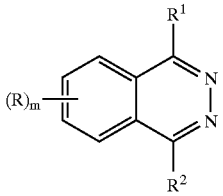

wherein R is a mono-valent substituent; m is an integer of 0 to 4, provided that when M is 2 or more, plural Rs may be the same or different and adjacent Rs may combine with each other to form an aliphatic ring, aromatic ring or heterocyclic ring; $R_1$ and $R_2$ are each a hydrogen atom or a mono-valent substituent;

formula (4)

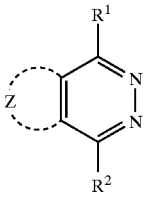

wherein Z is a non-metallic atom group necessary to form a 5-membered aromatic heterocycle; $R^1$ and $R^2$ are each a hydrogen atom or a mono-valent substituent;

formula (5)

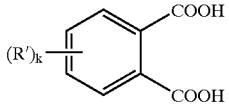

wherein R' is a mono-valent substituent; k is an integer of 0 to 4, provided that when k is 2 or more, plural ks may be same or different.

The substituents in the foregoing formulas (3), (4) and (5) are detailed in paragraph [0042], [0047] to [0049]. [0055] and [0056] of Japanese Patent Application No. 2001-366387.

Specific examples of the image tone modifiers represented by the foregoing formulas (3), (4) and (5) are shown below.

3-1

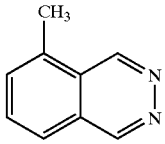

3-2

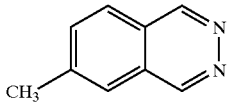

3-3

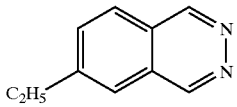

3-4

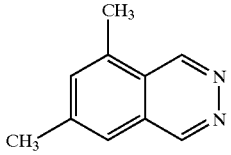

3-5

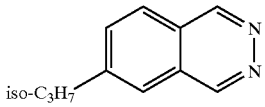

3-6

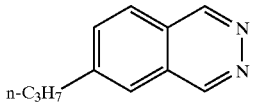

3-7

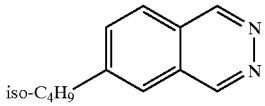

3-8

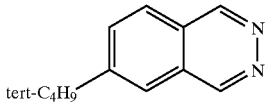

3-9

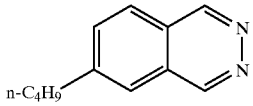

-continued
3-10
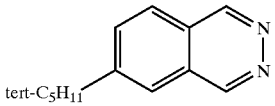
3-11
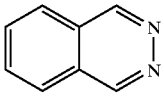
4-1
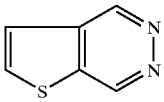
4-2
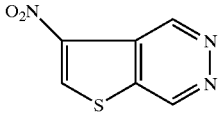
4-3
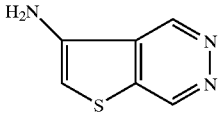
4-4
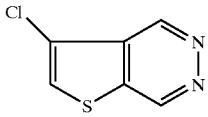
4-5
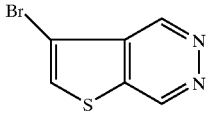
4-6
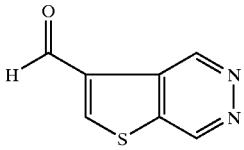
4-7
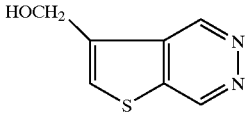
4-8
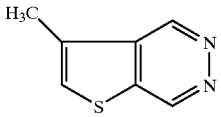
4-9
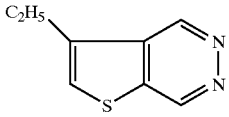
4-10
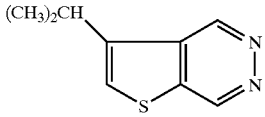
-continued
4-11
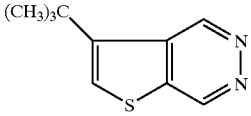
4-12
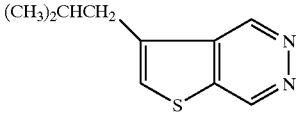
4-13
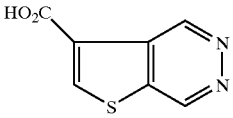
4-14
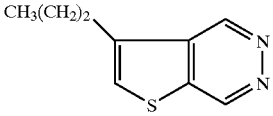
4-15
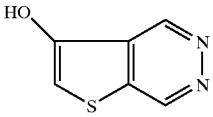
4-16
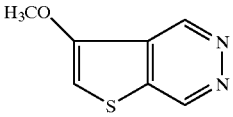
4-17
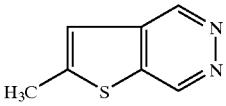
4-18
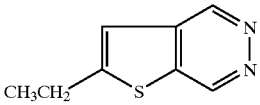
4-19
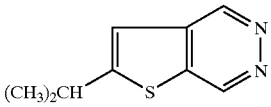
4-20
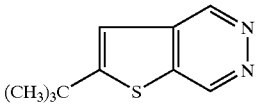
4-21
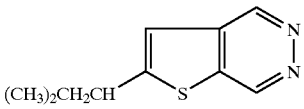
4-22
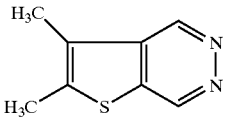
4-23
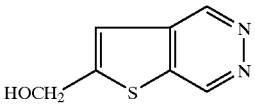

-continued
4-24
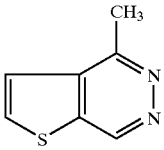
4-25
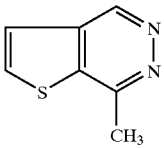
4-26
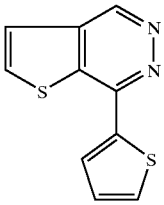
4-27
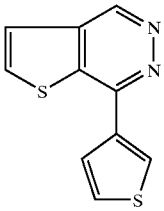
4-28
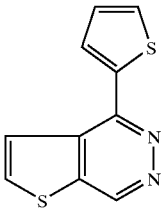
4-29
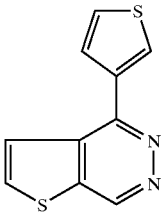
4-30
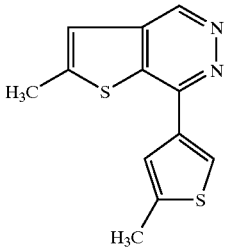
-continued
4-31
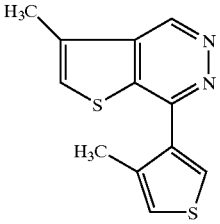
4-32
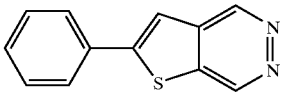
4-33
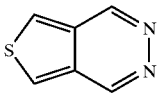
4-34
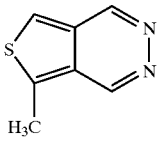
4-35
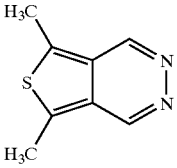
4-36
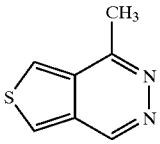
4-37
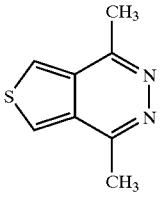
4-38
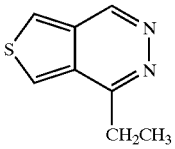
4-39
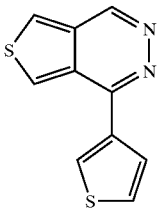

-continued 4-40

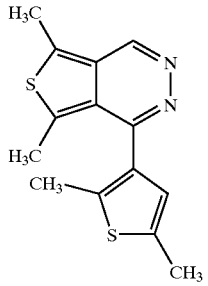

4-41

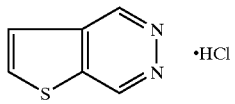

5-1

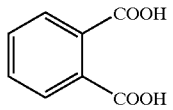

5-2

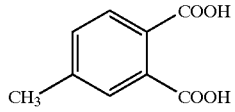

5-3

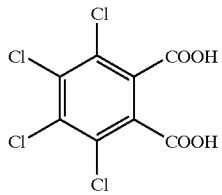

5-4

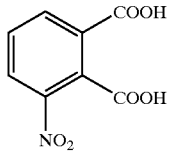

5-5

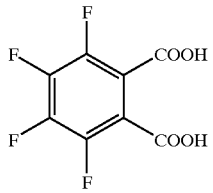

5-6

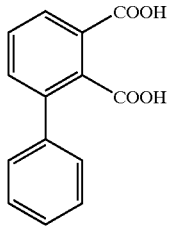

5-7

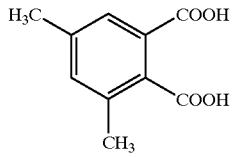

-continued 5-8

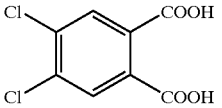

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The photothermographic material of the invention comprises at least one light-sensitive layer on the support, and further thereon, preferably having a light-insensitive layer. For example, a protective layer is provided on the light-sensitive layer. On the opposite side of the support to the light-sensitive layer, a back coating layer is preferably provided to protect the light-sensitive layer or prevent adhesion. Binders used in the protective layer or back coating layer are preferably selected from polymers which have a glass transition point higher than that of the thermally developable layer and are hard to cause abrasion or deformation, such as cellulose acetate and cellulose acetate-butyrate. To adjust contrast, two or more light-sensitive layers may be provided on one side of the support, or one or more layers may be provided on both sides of the support.

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material.

In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squarilium nucleus is a compound having a 1-cyclobutene-2-hydroxy-4one in the molecular structure and the compound containing chroconium nucleus is a compound having a 1-cyclopentene-2-hydroxy,4,5-dione in the molecular structure, in which the hydroxy group may be dissociated. Hereinafter, these dyes are collectively called a squarilium dye. Compounds described in JP-A 8-201959 are also preferably usable as a dye.

In one preferred embodiment of the invention, plural coating solutions are simultaneously coated to form multilayers and then subjected to a heating treatment.

Methods for simultaneously coating plural constituent layers are not specifically limited and commonly known methods, such as a bar coating method, curtain coating. method, air-knife method, hopper coating method and extrusion coating method are applicable. Of these, extrusion coating, that is, pre-measuring type coating is preferred. The extrusion coating is suitable for accurate coating or organic solvent coating since no evaporation occur on the slide surface, as in a slide coating system. This coating method is applicable not only to the light-sensitive layer side but also to the case when simultaneously coating a backing layer with the sublayer.

In this invention, a total silver coverage, which is dependent of the object of the photothermographic imaging material is optionally selected. In cases where intended to use images for medical check, the total silver coverage is preferably 0.6 to 2.5 g/m$^2$, and more preferably 1.0 to 1.7 g/m$^2$. Of the total silver coverage, a silver coverage of silver halide preferably account for 2 to 18%, and more preferably 3 to 15% of the total silver coverage.

The developing conditions for photothermographic materials are variable, depending on the instruments or apparatuses used, or the applied means and typically accompany heating the imagewise exposed photothermographic imaging material at an optimal high temperature. Latent images, which have been formed upon exposure to light are developed by heating the photothermographic material at an intermediate high temperature (ca. 80 to 200° C., and preferably 100 to 200° C.) over a period of ample time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior.

Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In this invention, laser-scanning exposure preferably conducts exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 μm, and more preferably not more than 100 μm. Thus, the smaller spot diameter preferably reduces the angle displaced from verticality of the laser incident angle. The lower limit of the beam spot diameter is 10 μm. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

Scanning-exposure using two or more laser beams is also preferred to form image. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 μm as a minor axis diameter and 5 to 100 μm as a major axis diameter. The laser scanning speed is set optimally for each photothermographic material, according to its sensitivity at the laser oscillation wavelength and the laser power.

EXAMPLES

The present invention will be further described based on examples but embodiments of the invention are by no means limited to these examples. Unless otherwise noted, the percentage (%) in the Examples represents weight percent (% by weight).

Example 1

Preparation of a Subbed PET Photographic Support

Both surfaces of a biaxially stretched thermally fixed 175 μm thick, blue (0.17, measured by densitometer PDA-65, produced by Konica Corp.) PET film, available on the market, was subjected to corona discharging at 8 w/m$^2$·min. Onto one side of the film, the subbing coating composition a-1 descried below was applied so as to form a dry layer thickness of 0.8 μm, which was then dried. The resulting coating was designated as a subbing layer A-1. Onto the opposite surface, the subbing coating composition b-1 described below was applied to form a dry layer thickness of 0.8 μm. The resulting coating was designated as a subbing layer B-1.

| Subbing coating composition a-1 | |
|---|---|
| Latex solution (30% solid) of a copolymer consisting of butyl acrylate/t-butyl acrylate/tyrene/2-hydroxyethyl acrylate (30/20/25/25%)) | 270 g |
| (C-1) | 0.6 g |
| Hexamethylene-1,6-bis(ethyleneurea) | 0.8 g |
| Water to make | 1 liter |
| **Subbing coating composition b-1** | |
| Latex liquid (30% solid) of a copolymer consisting of butyl acrylate/styrene/glycidyl acrylate (40/20/40%)) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharge at 8 w/m$^2$·minute. Onto the Subbing Layer A-1, the upper subbing layer coating composition a-2 described below was applied so as to form a dry layer thickness of 0.8 $\mu$m, which was designated as a subbing layer A-2, while onto the subbing layer B-1, the upper subbing layer coating composition b-2 was applied so as to form a dry layer thickness of 0.8 $\mu$m, having an anti static function, which was designated as a subbing upper layer B-2.

| Upper subbing layer coating composition a-2 | |
|---|---|
| Gelatin in an amount (weight) to make | 0.4 g/m$^2$ |
| (C-1) | 0.2 g |
| (C-2) | 0.2 g |
| (C-3) | 0.1 g |
| Silica particles (av. size 3 $\mu$m) | 0.1 g |
| Water to make | 1 liter |
| **Upper subbing layer coating composition b-2** | |
| (C-4) | 60 g |
| Latex solution [20% solid, comprising (C-5) as a substituent] | 80 g |
| Ammonium sulfate | 0.5 g |
| (C-6) | 12 g |
| Polyethylene glycol (average molecular weight of 600) | 6 g |
| Water to make | 1 liter |

(C-1)

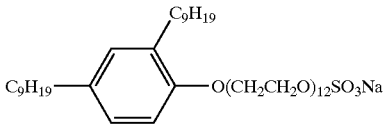

(C-2)

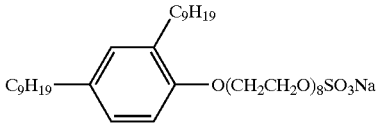

(C-3)

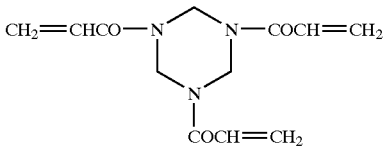

-continued (C-4)

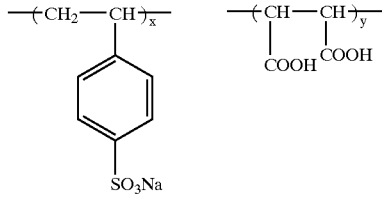

$\overline{M_n}$ = 5000 (number-averaged molecular weight)
X:y = 75:25 (by weight)

(C-5)

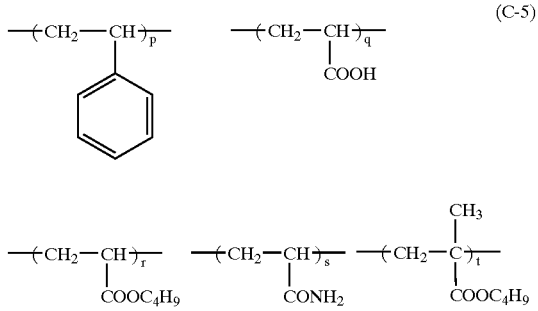

p:q:r:s:t = 40:5:10:5:40 (by weight)

(C-6) Mixture

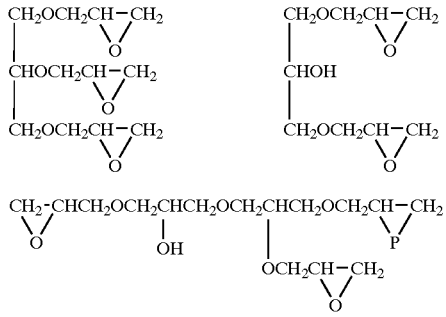

Back Layer Coating

To 830 g of methyl ethyl ketone (MEK), 84.2 g of cellulose acetate-butyrate (CAB381-20, available from Eastman Chemical Co.) and 4.5 g of polyester resin (Vitel PE2200B, available from Bostic Corp.) were added and dissolved. To the resulting solution were added 0.30 g of infrared dye 1 and further thereto, 4.5 g fluorinated surfactant (SURFLON KH40, available from Asahi Glass. Co., Ltd.) and 2.3 g of a fluorinated surfactant (MEGAFAC F120K, available from Dainippon Ink Co., Ltd.) which were previously dissolved in 43.2 g of methanol, were added with sufficiently stirring until being dissolved. To the resulting solution was added 75 g of silica particles (SYLOID 64X6000, available from W. R. Grace Co.), which were previously added to methyl ethyl ketone in a concentration of 1% by weight to prepare a coating solution for the backing layer side.

Infrared dye

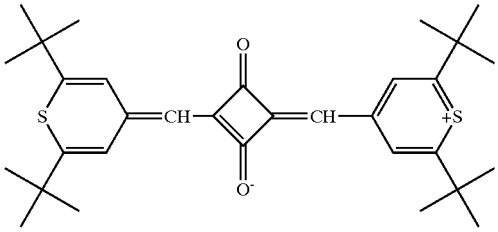

The thus prepared coating solutions were each coated on the support using an extrusion coater and dries so as to form a dry layer of 3.5 μm. Drying was conducted at a dry bulb temperature of 100° C. and a dew point of 10° C. over a period of 5 min.

Preparation of Light-Sensitive Silver Halide Emulsion A

| | |
|---|---|
| Solution A1 | |
| Phenylcarbamoyl gelatin | 88.3 g |
| Compound A* (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution | Amount necessary to adjust silver potential |
| Solution F1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |
| Compound (A) $HO(CH_2CH_2O)_n$—$(CH(CH_3)CH_2O)_{17}$—$CH_2CH_2O)_mH$ (m + n = 5 to 7) | |

Using a stirring mixer described in JP-B No. 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto, while the pAg was adjusted using solution E1. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1was added thereto to coagulate the resulting silver halide emulsion. Remaining 2000 ml of precipitates, the supernatant was removed and after adding 10 liters water with stirring, the silver halide emulsion was again coagulated. Remaining 1500 ml of precipitates, the supernatant was removed and after adding 10 liters water with stirring, the silver halide emulsion was again coagulated. Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained. It was proved that the resulting emulsion was comprised of monodisperse silver iodobromide cubic grains having an average grain size of 0.058 μm, a coefficient of variation of grain size of 12% and a [100] face ratio of 92%.

To the thus prepared emulsion was added 240 ml of sulfur sensitizer S-5 (0.5% methanol solution), further thereto, gold sensitizer Au-5 was added in an amount equivalent to 1/20 mol of the sulfur sensitizer and the emulsion was subjected to chemical sensitization at a temperature of 55° C. for a period of 120 min. with stirring.

Sulfer sensitizer (S-5)

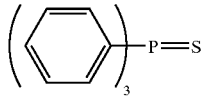

Gold sensitizer (Au-5)

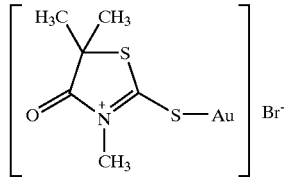

Preparation of Powdery Organic Silver Salt A

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion A obtained above and 450 ml of water were added and stirred for 5 min., while being maintained at 55° C. Subsequently, 702.6 ml of 1M aqueous silver nitrate solution was added in 2 min. and stirring continued further for 10 min. to obtain a dispersion of fatty acid silver salt. Thereafter, the thus obtained dispersion was transferred to a washing vessel and washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of nitrogen gas, according to the operation condition of a hot air temperature at the inlet of the dryer until reached a moisture content of 0.1% to obtain dried powdery organic silver salt A. The moisture content was measured by an infrared ray aquameter.

Preparation of Pre-dispersing Solution A

In 1457 g MEK was dissolved 14.57 g of polyvinyl butyral powder (Butvar B-79, available from Monsanto) and further thereto was gradually added 500 g of the powdery fatty acid silver salt A to obtain pre-dispersion B-3, while stirring by a dissolver (DISPERMAT Type CA-40, available from VMA-GETZMANN) to obtain a pre-dispersing solution A.

Preparation of Light-Sensitive Dispersion 1

Thereafter, using a pump, the pre-dispersion A was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time with a mill to obtain light-sensitive dispersion 1.

Preparation of Stabilizer Solution

In 4.97 g methanol were dissolved 1.0 g of Stabilizer 1 and 0.31 g of potassium acetate to obtain stabilizer solution.

Preparation of Infrared Sensitizing Dye Solution A

In 31.3 ml MEK were dissolved 19.2 mg of infrared sensitizing dye 1, 1.488 g of 2-chlorobenzoic acid, 2.779 g of Stabilizer-2 and 365 mg of 5-methyl-2-mercaptobenzimidazole in a dark room to obtain an infrared sensitizing dye solution A.

Preparation of Additive Solution (a)

In 110 g MEK were dissolved 27.98 g of 1,1-bis(2-hydroxy-3,5-dimethylphen1)-2-methylpropane, 1.54 g of 4-methylphthalic acid and 0.48 g of the infrared dye-1 to obtain additive solution (a).

Preparation of Additive Solution (b)

2 g of antifoggant 2 was dissolved in 40.9 g MEK to obtain additive solution (b).

Structures of additives used herein are shown below.

maintaining the temperature at 13° C., and 1.084 g of tetrachlorophthalic acid (9.4% MEK solution) and stirred for 15 min. Then, 12.43 g of additive solution (a), 1.6 ml of 10% MEK solution of Desmodur N3300 (aliphatic isocyanate, available from Movey Co.) and 4.27 g of additive solution (b) were successively added with stirring to obtain coating solution A of the light-sensitive layer.

Preparation of Matting Agent Dispersion

In 42.5 g of methyl ethyl ketone, 75 g of cellulose acetate-butyrate (CAB171-15, available from Eastman Chemical Co.) was was dissolved and further thereto, 5 g of calcium carbonate (Super-Pflex 200, available from Specificality Mineral Co.) was added and dispersed with stirring and by a dissolver type stirrer at 8000 rpm for 30 min. to obtain a matting agent-dispersing solution.

Preparation of Surface Protective Layer Coating Solution

In 865 g MEK were dissolved with stirring 96 g of cellulose acetate-butyrate (CAV 171-15), 4.5 g of polymethyl methacrylic acid (Paraloid A-21, Rohm & Haas Co.). 4.5 g of vinylsulfone compound (HD-1), 1.0 g of benztriazole and 1.0 g of fluorinated surfactant (Surflon KH 40, available from Asahi Glass Co., Ltd.). Then, 30 g of the matting agent dispersion was added with stirring to obtain a coating solution of the surface protective layer.

$(CH_2{=}CHSO_2CH_2)_2CHOH$ HD-1

Stabilizer 1

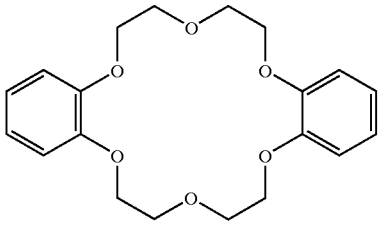

Stabilizer 2

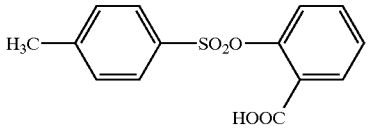

Antifoggant

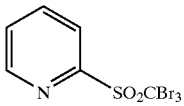

Infrared sensitizing dye S-43

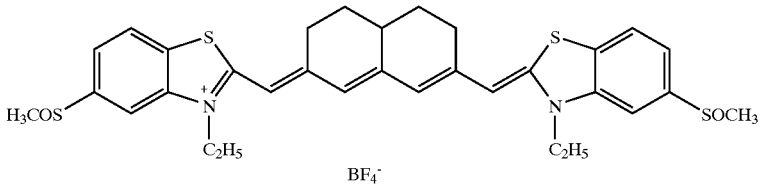

Preparation of Light-sensitive Layer Coating Solution A

Under inert gas atmosphere (97% nitrogen), 50 g of the light-sensitive emulsion A and 15.11 g MEK were maintained at 21° C. with stirring, and 390 μm of antifoggant 1 (10% methanol solution) was added and stirred for 1 hr. Further thereto, 494 μl of calcium bromide (10% methanol solution) was added and stirred for 20 min. Subsequently, 167 ml of the stabilizer solution was added and after stirring for 10 min., 1.32 g of the foregoing infrared sensitizing dye solution was added and stirred for 1 hr. Then, the mixture was cooled to 13° C. and stirred for 30 min. Further thereto, 13.31 g of polyvinyl butyral (Butvar B-79, available from Monsanto Co.) was added and stirred for 30 min, while Light-Sensitive Layer-Side Coating The light-sensitive layer coating solution and surface protective layer coating solution were simultaneously coated using an extrusion coater so that the light-sensitive layer had a silver coverage of 1.9 g/m$^2$ and the protective layer had a dry layer thickness of 2.5 μm. Then drying was conducted for 10° C. at a dry bulb temperature of 75° C. and a dew temperature of 10° C. Thus, photothermographic material sample No. 1 was prepared.

Photothermographic material samples were prepared similarly to sample No. 1, provided that surfactant KH40 used in the back layer (hereinafter, also denoted as a conductive layer) was replaced by compounds shown in Table 1 and compounds used in the light-sensitive layer were also varied as shown in Table 1.

Image Recording and Image Evaluation

Photothermographic material samples were each subjected to laser scanning exposure under light shielding at room temperature (23° C., 55% RH) from the light-sensitive layer side with varying exposure through an optical wedge chart, using an exposure apparatus having a light source of 800 to 820 nm semiconductor laser of a longitudinal multimode (max. output of 35 mV), which was made by means of high frequency overlapping. Subsequently, the thus exposed samples were thermally developed at 123° C. for a period of 12 sec. using an automatic processor provided with a heated roller so that the protective layer was brought into contact with the heated roller. Laser scanning exposure was conducted at an angle between the exposed surface of the photothermographic material sample and a laser beam, with an ellipsoidal laser spot diameter of 100 μm in the main scanning direction and 75 μm in the sub-scanning direction, and at a laser scanning pitch of 100 μm in the main scanning direction and 75 μm in the sub-scanning direction. The processor was provided with a heated roller having a surface rubber hardness of 70, as defined in JIS K6253 Type A.

The thus processed samples were each measured with respect to maximum density (Dmax) and minimum density (Dmin) using densitometer PDA-65 (available from Konica Corp.) A visual transmission density was measured at ten points in the maximum exposure area (down to two places of decimals), and the average value thereof was defined as the maximum density (Dmax). A visual transmission density was measured at ten points in the non-exposure area (down to three places of decimals), and the average value thereof was defined as the minimum density (Dmin).

Evaluation (1)

Each of the samples was evaluated with respect to an extent of occurrence of unevenness in density when continuously processed. Thus, a photothermographic material sheet of 35.5×43.2 cm was exposed so as to give a density of 0.8 and thermally developed. 100 Sheets of each sample were continuously processed and the 100th processed sheet was visully evaluated with unevenness in density, based on the following criteria:

A: No unevenness was observed,

B: Unevenness was slightly observed,

C: Unevenness was observed.

Evaluation (2)

Using samples used in the foregoing evaluation 1, the density difference between the Dmax and Dmin was determined and evaluated as a measure of contrast.

Results are shown in Table 1.

TABLE 1

| Sample No. | Conductive Layer | Light-sensitive Layer Compound | Light-sensitive Layer Compound | Evaluation (1) | Evaluation (2) | Remark |
|---|---|---|---|---|---|---|
| 1 | KH40*1 | MMBI*2 | 3-11/5-2/5-3 | C | 3.35 | Comp. |
| 2 | 2c-1/ 2f-10*3 | MMBI | 3-1/5-2/5-3 | A | 3.40 | Inv. |
| 3 | 2c-2/2f-3 | 6-32 | 3-4/5-2/5-3 | A | 3.41 | Inv. |
| 4 | 2c-3/2f-6 | 6-1 | 3-8/5-1/5-3 | A | 3.47 | Inv. |
| 5 | 2c-4/2f-1 | 6-21 | 3-11/5-2/5-3 | A | 3.49 | Inv. |
| 6 | 2c-3 | 6-21 | 3-11/5-1/5-3 | A | 3.40 | Inv. |
| 7 | 2b-1 | 6-21 | 2-1/5-1/5-3 | A | 3.40 | Inv. |
| 8 | 2d-5/2f-10 | MMBI | 3-1/5-2/5-3 | A | 3.41 | Inv. |
| 9 | 2d-15/2f-3 | MMBI/ 4-1*4 | 3-4/5-2/5-3 | A | 3.43 | Inv. |
| 10 | 2d-17/2f-6 | MMBI/ 4-1*5 | 3-4/5-2/5-3 | A | 3.42 | Inv. |
| 11 | 2d-9/2f-1 | 6-21 | 3-11/5-2/5-3 | A | 3.46 | Inv. |
| 12 | 2d-6/2f-2 | 6-1 | 3-11/5-1/5-3 | A | 3.47 | Inv. |
| 13 | 2e-3/2f-5 | 6-5 | 4-1/5-2/5-3 | A | 3.41 | Inv. |
| 14 | 2e-5/2f-8 | 6-32 | 4-7/5-2/5-3 | A | 3.43 | Inv. |
| 15 | 2e-10/2f-4 | 6-33 | 4-17/5-7/5-3 | A | 3.42 | Inv. |

*1SURFLON KH40, available from Asahi Glass. Co., Ltd.
*2 5-Methyl-2-mercaptobenzimidazole (MMBI)
*3 37.5 wt % of compound (2c),(2d) or (2f) of compound (2f)
*4 MMBI/4-1 = 9/1
*5 MMBI/4-1 = 5/5

As apparent from Table 1, it was proved that inventive samples led to superior results.

Example 2

Preparation of Subbed Support

On one side of 175 μm thick polyethylene terephthalate (PET) film which was previously subjected to a corona discharge treatment at 12 W/m$^2$·min, sublayer A-1 was coated using the following sublayer coating solution a-1 so as to have a dry layer thickness of 0.6 μm. After the other side of the film was also subjected to a corona discharge treatment, sub-layers B-1 was coated thereon using sublayer coating solutions b-1 described below so as to have dry layer thickness of 0.6 μm.

Sub-Coating Solution a-1

Copolymer latex solution (30% solids) comprising n-butyl acrylate, t-butyl acrylate, styrene and 2-hydroxyethyl acrylate (30/20/25/25%) was diluted to 15 times.

Sub-Coating Solution b-1

Copolymer latex solution (30% solids) comprising n-butyl acrylate, styrene and glycidyl acrylate (40/20/40%) was diluted to 15 times.

Subsequently, the respective surfaces of the sublayer A-1 and B-1 were subjected to corona discharge at 12 W/m$^2$·min. On the sublayer A-1, sub-coating solution a-described below was coated and dried to form upper sublayer A-2, and on the sublayer B-1, sub-coating solution b-2 described below was coated and dried to form upper sublayer B-2 having antistatic function. Numerals designate a coating amount per m$^2$.

| | |
|---|---|
| Upper sub-layer coating solution a-2 | |
| Styrene/butadiene copolymer (1/2 by weight) | 0.4 g |
| Silica particles | 0.05 g |
| Upper sub-layer coating solution b-2 | |
| Styrene/butadiene copolymer (1/2 by weight) | 0.4 g |
| Tin oxide fine particles (av. size of 16 μm) | 0.023 g |

Preparation of Silver Halide Emulsion A

In 900 ml of deionized water were dissolved 7.5 g of inert gelatin and 10 mg of potassium bromide. After adjusting the temperature and the pH to 28° C. and 3.0, respectively, 370 ml of an aqueous solution containing 74 g silver nitrate and an equimolar aqueous halide solution containing potassium bromide, potassium iodide (in a molar ratio of 98 to 2) were added over a period of 10 minutes by the controlled double-jet method, while the pAg was maintained at 7.7. Hexachloroiridate of $10^{-6}$ mol/mol Ag was added in parallel to the addition of silver nitrate. Thereafter, 4-hydroxy-6-methyl-1,3,3a,7-tetraazaindene was added and the pH was adjusted to 5 using NaOH. There was obtained cubic silver iodobromide grains having an average grain size of 0.036 μm, a variation coefficient of the projection area equivalent diameter of 8%, and the proportion of the {100} face of 87%. The resulting emulsion was flocculated to remove soluble salts, employing a flocculating agent and after desalting, was added to make 160 ml.

Preparation of Organic Silver Salt Dispersion

In 2980 ml water were dissolved 111.4 g of behenic acid, 83.8 g of arachidic acid and 54.9 g of stearic acid at 80° C. Then, after adding 540.2 ml of 1.5M aqueous sodium hydroxide solution with vigorously stirring and further adding 6.9 ml of concentrated nitric acid, the solution was cooled to a temperature of 55° C. to obtain an aqueous organic acid sodium salt solution. To the solution were added the silver halide emulsion A obtained above (containing equivalent to 0.038 mol silver) and 420 ml of pure water and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried to obtain organic silver salt.

Light-Sensitive Layer-Side Coating

On the sublayer A-2 of the support, an AH layer, light-sensitive layer and protective layer were each successively coated in that order and dried at 45° C. to prepare a photothermographic material. Numerals in the respective coating composition designate a coating amount per $m^2$.

| AH layer coating composition | |
|---|---|
| Binder (PVB-1) | 0.8 g |
| C-1 (dye | $1.2 \times 10^{-5}$ mol |
| **Light-sensitive layer coating composition** | |
| Binder (PVB-1) | 5.0 g |
| SD-1 (spectral sensitizing dye) | $2 \times 10^{-5}$ mol |
| Pyridinium hydrobromide perbromide (antifoggant) | 0.3 g |
| Isothiazolone (antifoggant) | 1.2 mg |
| Reducing agent (A-4) | 3.3 mmol |
| 6-iso-propylphthalazine | $2 \times 10^{-4}$ mol |

The foregoing composition was prepared and mixed with the foregoing organic silver salt. The mixture was coated so as to have a silver coating amount of 1.36 g/$m^2$ and dried to form a light-sensitive layer. The following composition was coated on the light-sensitive layer so as to have the following coating amount (per $m^2$) and dried to form a protective layer.

| Protective layer coating composition | |
|---|---|
| Cellulose acetate-butyrate | 2.0 g |
| 4-Methylphthalic acid | 0.7 g |
| Tetrachlorophthalic acid | 0.2 g |
| Tetrachlorophthalic acid anhydride | 0.5 g |
| Silica matting agent (av. size 5 μm) | 0.5 g |

C-1

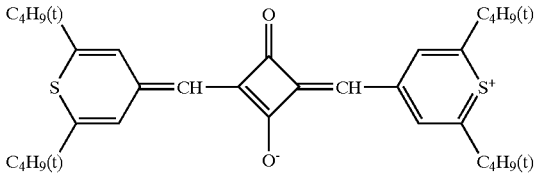

SD-1

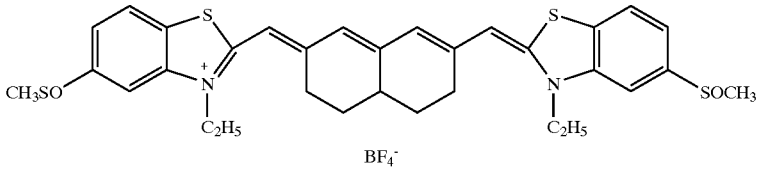

In foregoing, as the binder (PVB-1), polyacetal was used, which was dispersed in methyl ethyl ketone (MEK) and added with additives, followed by being coated. The polyacetal was obtained by saponifying polyvinyl acetate having a polymerization degree of 500 to a level of 98%, followed by 98% of the remaining hydroxyl group being varied to butyral.

BC Layer-Side Coating

On the sublayer B-2, a conductive layer having the following composition was coated and dried to form a BC layer. Thus, to 830 g of MEK were added 84.2 g of cellulose acetate-butyrate (CAB 381-20, available from Eastman Chemical Co.) and 4.5 g of polyester resin (Vitel PE2200B, available from Bostic Co.) were added with stirring and dissolved. Then, 0.30 g of dye (C-1) was added and 4.5 g of a fluorinated surfactant (Surflon KH40, available from Asahi Glass Co., Ltd.), dissolved in 43.2 g of methanol was added thereto and stirred until dissolved. Finally, 75 g of a 1% MEK solution of silica (Siloid 64 X6000, available from W. R. Grace Co.), which was dispersed by a dissolver type homogenizer was added and stirred to prepare a coating solution of the BC layer. The thus prepared BC layer coating solution was coated using an extrusion coater so as to have a dry layer thickness of 3.5 $\mu$m and dried at a dry bulb temperature of 100° C. and a dew temperature of 10° C. over 5 min.

On the basis of the foregoing, compounds to be contained in the light-sensitive layer and conductive layer, as shown in Table 1. The compounds were incorporated in equimolar amounts, based on the comparative sample. In the Table 1, image tone modifiers [compounds of formula (1) or (1a)] were incorporated into the AH layer, light-sensitive layer and protective layer in amounts as below:

AH layer: $1\times10^{-5}$ mol/m$^2$, protective layer: $1\times10^{-5}$ mol/m$^2$.

As shown in Table 1, a cross-linking agent was incorporated into the light-sensitive layer in an amount of $2\times10^{-4}$ mol/m$^2$; the protective layer, $0.8\times10^{-4}$ mol/m$^2$; the AH layer, $0.9\times10^{-4}$ mol/m$^2$; and the BC layer, $2.8\times10^{-4}$ mol/m$^2$.

Photothermographic material samples No. 100 through 125 were thus prepared and evaluated with respect to image characteristics according to the following procedure.

Image Recording and Image Evaluation

Photothermographic material samples were exposed, thermally processed and evaluated similarly to Example 1. Samples were further evaluated according to the following procedure.

Evaluation (3)

Exposed and processed samples were allowed to stand on a viewing box for 10 hr. and visually evaluated with respect to image tone, based on the following criteria:

AA: Image tone and uniformity with no problem,

A: Image tone and uniformity acceptable in practice,

B: Unpleasant image tone with partial yellowish/reddish unevenness, unacceptable in practice, C: Markedly non-uniform tone, unacceptable in practice.

Results are shown in Table 2

TABLE 2

| Sam-le | Conductive | Light-sensitive Layer | | Compound | | | | Evaluation | | | Re- |
|---|---|---|---|---|---|---|---|---|---|---|---|
| | | | | AH | Light-sensi-tive | Pro-tec-ive | Cross-linking | | | | |
| No. | Layer | Sensitizer | Tone Modiier | Layer | Layer | Layer | Agent | (1) | (2) | (3) | mark |
| 100 | KH40 | MMBI | 3-1/5-2/5-3 | — | — | — | — | C | 3.35 | B | Comp. |
| 101 | 2a-2/2f-1 | MMBI | 3-1/5-1/5-3 | — | 1a-1 | — | — | A | 3.46 | A | Inv. |
| 102 | 2a-3/2f-2 | MMBI/4-1 (9/1) | 3-2/5-2/5-3 | — | 1a-2 | 1a-2 | H-2 | A | 3.41 | AA | Inv. |
| 103 | 2a-4/2f-3 | MMBI/4-1 (5/5) | 3-3/5-3/5-3 | — | 1a-3 | — | H-10 | A | 3.43 | AA | Inv. |
| 104 | 2a-5/2f-4 | MMBI/4-1 (1/9) | 3-4/5-4/5-3 | 1a-4 | 1a-4 | 1a-4 | H-16 | A | 3.42 | AA | Inv. |
| 105 | 2a-6/2f-5 | 6-21 | 3-5/5-5/5-3 | — | 1a-5 | — | — | A | 3.48 | A | Inv. |
| 106 | 2a-7/2f-6 | 6-1 | 3-6/5-9/5-3 | 1a-6 | 1a-6 | — | — | A | 3.45 | A | Inv. |
| 107 | 2a-8/2f-7 | 6-2 | 3-7/5-7/5-3 | — | 1a-7 | 1a-7 | H-6 | A | 3.43 | AA | Inv. |
| 108 | 2a-9/2f-8 | 6-3 | 3-8/5-2/5-3 | — | 1a-8 | — | — | A | 3.42 | A | Inv. |
| 109 | 2a-10/2f-9 | 6-4 | 3-9/5-1/5-3 | — | 1a-9 | — | — | A | 3.41 | AA | Inv. |
| 110 | 2a-13/2f-10 | 6-6 | 3-10/5-2/5-3 | — | 1a-10 | 1a-10 | — | A | 3.45 | A | Inv. |
| 111 | 2a-14/2f-3 | 6-7 | 3-11/5-7/5-3 | — | 1a-1 | — | — | A | 3.42 | A | Inv. |
| 112 | 2b-2 | 6-8 | 3-11/5-1/5-3 | — | 1-1 | — | — | B | 3.44 | A | Inv. |
| 113 | 2c-1/2f-1 | MMBI | 3-1/5-1/5-3 | — | 1a-1 | — | — | A | 3.45 | A | Inv. |
| 114 | 2c-2/2f-3 | MMBI/4-1 (5/5) | 3-2/5-2/5-3 | 1a-2 | 1a-2 | — | — | A | 3.42 | A | Inv. |
| 115 | 2c-3/2f-6 | MMBI/4-1 (1/9) | 3-4/5-3/5-3 | 1a-3 | 1a-3 | 1a-3 | CI-1 | A | 3.43 | AA | Inv. |
| 116 | 2c-4/2f-10 | 6-1 | 3-8/5-6/5-3 | — | 1a-4 | 1a-4 | — | A | 3.45 | A | Inv. |
| 117 | 2c-3 | 6-21 | 3-11/5-7/5-3 | — | 1-4 | — | — | B | 3.41 | A | Inv. |
| 118 | 2d-5/2f-10 | MMBI | 3-1/5-2/5-3 | — | 1a-1 | — | H-2 | A | 3.42 | AA | Inv. |
| 119 | 2d-15/2f-6 | MMBI/4-1 (5/5) | 3-4/5-2/5-3 | — | 1a-2 | — | — | A | 3.46 | A | Inv. |
| 120 | 2d-13/2f-1 | MMBI/4-1 (1/9) | 3-17/5-1/5-3 | — | 1a-3 | — | — | A | 3.41 | A | Inv. |
| 121 | 2d-9/2f-3 | 6-21 | 4-1/5-2/5-3 | — | 1a-4 | — | — | A | 3.41 | A | Inv. |
| 122 | 2d-6/2f-4 | 6-1 | 3-8/5-1/5-3 | — | 1a-5 | — | — | A | 3.48 | A | Inv. |
| 123 | 2e-3/2f-5 | 6-5 | 3-11/5-2/5-3 | — | 1a-6 | 1a-6 | — | A | 3.42 | A | Inv. |
| 124 | 2e-5/2f-2 | 6-32 | 4-7/5-2/5-3 | 1a-10 | 1a-10 | 1a-10 | — | A | 3.44 | AA | Inv. |
| 125 | 2e-10 | 6-33 | 3-11/5-7/5-3 | — | 1-9 | — | — | B | 3.43 | A | Inv. |

As apparent from Table 2, it was proved that inventive samples led to superior results.

What is claimed is:

1. A silver salt photothermographic material comprising on a support a light-sensitive layer comprising a light-sensitive emulsion containing organic silver salt grains and light-sensitive silver halide grains, a reducing agent and a binder and a conductive layer, wherein the conductive layer contains at least one of compounds represented by the following formulas (2b) through (2e):

$$(Rf_2)\cancel{)(A_2)}_s \qquad \text{formula (2b)}$$

wherein $Rf_2$ represents a fluorine-containing group; $A_2$ represents an anion group or its salt; and s is an integer of 2 to 5;

$$LiO_3S\text{-}(CF_2)_m\text{-}SO_3Li \qquad \text{formula (2c)}$$

wherein m is an integer of 1 to 4;

$$MO_3S\text{-}(CF_2)_t\text{-}SO_3M \qquad \text{formula (2d)}$$

wherein M represents H, Na, K or an ammonium group; t is a positive integer, provided that when M is H, t is 1 to 6 or 8, when M is Na, t is 4, when M is K, t is 1 to 6, and when M is an ammonium group, t is 1 to 8;

$$L[O_3S\text{-}(CF_2)_u\text{-}SO_3] \qquad \text{formula (2e)}$$

wherein L is Ba, Ca or Mg; u is a positive integer, provided that when L is Ba, u is 1 to 5, when L is Ca or Mg, u is 1 to 8.

2. The photothermographic material of claim 1, wherein the conductive layer contains the compound represented by formula (2b).

3. The photothermographic material of claim 1, wherein the conductive layer contains the compound represented by formula (2c).

4. The photothermographic material of claim 1, wherein the conductive layer contains the compound represented by formula (2d).

5. The photothermographic material of claim 1, wherein the conductive layer contains the compound represented by formula (2e).

6. The photothermographic material of claim 1, wherein at least one of the light-sensitive layer and a layer adjacent to the light-sensitive layer contains a compound represented by the following formula (1):

formula (1)

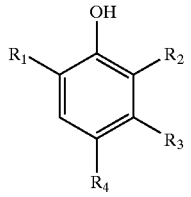

wherein $R_1$ represents an alkyl group, or a cycloalkyl group and $R_2$ represents a hydrogen atom, an alkyl group, a cycloalkyl group, or an acylamino group, provided that neither $R_1$ nor $R_2$ is 2-hydroxyphenylmethyl; $R_3$ represents a hydrogen atom, a cycloalkyl group, or an alkyl group; and $R_4$ represents a substituent group.

7. The photothermographic material of claim 1, wherein at least one of the light-sensitive layer and a layer adjacent to the light-sensitive layer contains a compound represented by the following formula (1a):

formula (1a)

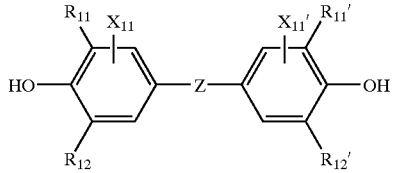

wherein Z represents —S— or —C($R_{13}$) ($R_{13}$')—, in which $R_{13}$ and $R_{13}$' each represent a hydrogen atom or a substituent; $R_{11}$, $R_{12}$, $R_{11}$' and $R_{12}$' each represent a substituent; $X_{11}$ and $X_{11}$'each represent a hydrogen atom or a substituent.

8. The photothermographic material of claim 1, wherein the conductive layer contains a compound represented by the following formula (2f):

$$Rf_3\text{-}(AO)_k\text{-}Rf_4 \qquad \text{formula (2f)}$$

wherein $Rf_3$ and $Rf_4$ each represent a fluorine-containing aliphatic group; AO represents a group containing at least one alkyleneoxy group; k is an integer of 1 to 30.

9. The photothermographic material of claim 1, wherein the light-sensitive layer contains a thiuronium compound represented by the following formula (6):

formula (6)

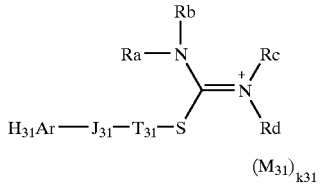

wherein $H_{31}Ar$ represent an aromatic hydrocarbon group or an aromatic heterocyclic group; $T_{31}$ represents a bivalent aliphatic hydrocarbon linkage group or a bond; $J_{31}$ represents a bivalent linking group containing at least one of an oxygen atom, sulfur atom and nitrogen atom, or a bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to compensate for an intramolecular charge; and $k_{31}$ represents the number of the ion necessary to compensate for an intramolecular charge.

10. The photothermographic material of claim 1, wherein the light-sensitive layer contains 5-methyl-2-mercaptobenzimidazole.

11. The photothermographic material of claim 1, wherein the light-sensitive layer contains at least one of compounds represented by the following formulas (3), (4) and (5):

formula (3)

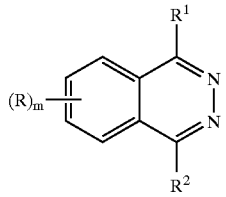

wherein R is a univalent substituent; m is an integer of 0 to 4, provided that adjacent Rs may combine with each other to form an aliphatic ring, aromatic ring or heterocyclic ring; $R_1$ and $R_2$ are each a hydrogen atom or a univalent substituent;

formula (4)

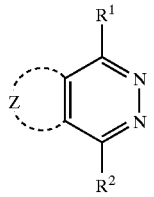

wherein Z is a non-metallic atom group necessary to form a 5-membered aromatic heterocycle; $R^1$ and $R^2$ are each a hydrogen atom or a univalent substituent;

formula (5)

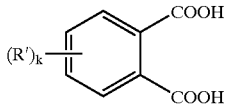

wherein R' is a univalent substituent; k is an integer of 0 to 4.

12. The photothermographic material of claim 1, wherein the conductive layer is provided on the opposite side of the support from the light-sensitive layer.

13. A silver salt photothermographic material comprising on a support a light-sensitive layer comprising a light-sensitive emulsion containing organic silver salt grains and light-sensitive silver halide grains, a reducing agent, a binder, a conductive layer, a sensitizer and a tone modifier, wherein at least one of the light-sensitive layer and a layer adjacent to the light-sensitive layer contains a compound represented by formula (1) and the conductive layer contains a compound represented by formula (2a):

formula (1)

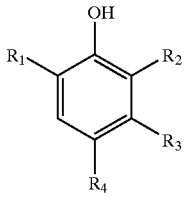

wherein $R_1$ represents an alkyl group, or a cycloalkyl group and $R_2$ represents a hydrogen atom, an alkyl group, a cycloalkyl group, or an acylamino group, provided that neither $R_1$ nor $R_2$ is 2-hydroxyphenylmethyl; $R_3$ represents a hydrogen atom, a cycloalkyl group, or an alkyl group; and $R_4$ represents a substituent group;

$$(Rf_1)_p\text{-}(Y)\text{-}(A_1)_q \qquad \text{formula (2a)}$$

wherein $Rf_1$ represents a fluorine-containing group; Y represents a linkage group containing no fluorine; $A_1$ represents an anion group or its salt; p is an integer of 1 to 5 and q is an integer of 1 to 5, provided that $A_1$ is not $SO_3K$ when p and q are each 1, $Rf_1$ is $—C_8F_{17}$ and Y is $—CH_2CH_2—$.

14. The photothermographic material of claim 13, wherein the conductive layer contains a compound represented by the following formula (2f):

$$Rf_3\text{-}(AO)_k\text{-}Rf_4 \qquad \text{formula (2f)}$$

wherein $Rf_3$ and $Rf_4$ each represent a fluorine-containing aliphatic group; AO represents a group containing at least one alkyleneoxy group; k is an integer of 1 to 30.

15. The photothermographic material of claim 13, wherein Y further contains no nitrogen.

16. A silver salt photothermographic material comprising on a support a light-sensitive layer comprising a light-sensitive emulsion containing organic silver salt grains and light-sensitive silver halide grains, a reducing agent, a binder, a conductive layer, a sensitizer and a tone modifier, wherein at least one of the light-sensitive layer and a layer adjacent to the light-sensitive layer contains a compound represented by formula (1a) and the conductive layer contains a compound represented by formula (2a):

formula (1a)

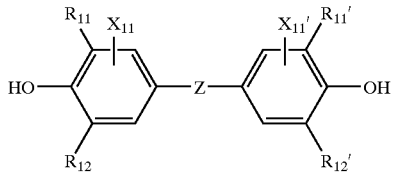

wherein Z represents —S— or —C($R_{13}$) ($R_{13}$')—, in which $R_{13}$ and $R_{13}$' each represent a hydrogen atom or a substituent; $R_{11}$, $R_{12}$, $R_{11}$' and $R_{12}$' each represent a substituent; $X_{11}$ and $X_{11}$' each represent a hydrogen atom or a substituent;

$$(Rf_1)_p\text{-}(Y)\text{-}(A_1)_q \qquad \text{formula (2a)}$$

wherein $Rf_1$ represents a fluorine-containing group; Y represents a linkage group containing no fluorine; $A_1$ represents an anion group or its salt; p is an integer of 1 to 5 and q is an integer of 1 to 5, provided that $A_1$ is not $SO_3K$ when p and q are each 1, $Rf_1$ is $—C_8F_{17}$, and Y is $—CH_2CH_2—$.

17. The photothermographic material of claim 16, wherein Y further contains no nitrogen.

* * * * *